US009121086B2

(12) United States Patent
Oishi et al.

(10) Patent No.: US 9,121,086 B2
(45) Date of Patent: Sep. 1, 2015

(54) COPPER ALLOY SHEET AND METHOD FOR MANUFACTURING COPPER ALLOY SHEET

(71) Applicant: Mitsubishi Shindoh Co., Ltd., Tokyo (JP)

(72) Inventors: Keiichiro Oishi, Osaka (JP); Kouichi Suzaki, Osaka (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 0 days.

(21) Appl. No.: 14/163,932

(22) Filed: Jan. 24, 2014

(65) Prior Publication Data

US 2014/0202602 A1 Jul. 24, 2014

Related U.S. Application Data

(62) Division of application No. PCT/JP2012/073630, filed on Sep. 14, 2012.

(30) Foreign Application Priority Data

Sep. 16, 2011 (JP) ..... 2011-203452

(51) Int. Cl.
*C22F 1/08* (2006.01)
*C22C 21/10* (2006.01)
(Continued)

(52) U.S. Cl.
CPC . *C22C 21/10* (2013.01); *B21B 1/22* (2013.01); *B21B 3/00* (2013.01); *C22C 9/04* (2013.01); *C22F 1/00* (2013.01); *C22F 1/08* (2013.01); *H01B 1/026* (2013.01); *C22C 13/00* (2013.01)

(58) Field of Classification Search
CPC ..... C22C 9/02; C22C 9/06; H01B 1/026
USPC ..... 148/412, 501, 681
See application file for complete search history.

(56) References Cited

U.S. PATENT DOCUMENTS

2009/0224379 A1 9/2009 Miwa et al.
2010/0047112 A1 2/2010 Fugono et al.
(Continued)

FOREIGN PATENT DOCUMENTS

JP 63-161135 A 7/1988
JP 01-189805 A 7/1989
(Continued)

OTHER PUBLICATIONS

International Search Report issued in related application PCT/JP2012/073641, completed Nov. 15, 2012 and mailed Dec. 4, 2012.
(Continued)

*Primary Examiner* — Kaj K Olsen
*Assistant Examiner* — Alexander Polyansky
(74) *Attorney, Agent, or Firm* — Griffin & Szipl, P.C.

(57) ABSTRACT

An aspect of the copper alloy sheet contains 5.0 mass % to 12.0 mass % of Zn, 1.1 mass % to 2.5 mass % of Sn, 0.01 mass % to 0.09 mass % of P and 0.6 mass % to 1.5 mass % of Ni with a remainder of Cu and inevitable impurities, and satisfies a relationship of $20 \leq [Zn]+7\times[Sn]+15\times[P]+4.5\times[Ni] \leq 32$. The aspect of the copper alloy sheet is manufactured using a manufacturing process including a cold finishing rolling process in which a copper alloy material is cold-rolled, the average crystal grain diameter of the copper alloy material is 1.2 μm to 5.0 μm, round or oval precipitates are present in the copper alloy material, the average grain diameter of the precipitates is 4.0 nm to 25.0 nm or a proportion of precipitates having a grain diameter of 4.0 nm to 25.0 nm in the precipitates is 70 % or more.

8 Claims, 1 Drawing Sheet

(51) Int. Cl.

| | |
|---|---|
| ***B21B 1/22*** | (2006.01) |
| ***B21B 3/00*** | (2006.01) |
| ***C22C 9/04*** | (2006.01) |
| ***C22F 1/00*** | (2006.01) |
| ***H01B 1/02*** | (2006.01) |
| *C22C 9/02* | (2006.01) |
| *C21D 11/00* | (2006.01) |
| *C22C 13/00* | (2006.01) |

(56) References Cited

U.S. PATENT DOCUMENTS

| | | | | |
|---|---|---|---|---|
| 2011/0265917 | A1* | 11/2011 | Oishi | 148/501 |
| 2014/0166164 | A1 | 6/2014 | Oishi et al. | |

FOREIGN PATENT DOCUMENTS

| | | | | |
|---|---|---|---|---|
| JP | 06-184679 | A | | 7/1994 |
| JP | 2000-087158 | A | | 3/2000 |
| JP | 2002-530523 | A | | 9/2002 |
| JP | 2002-294368 | A | | 10/2002 |
| JP | 2006-283060 | A | | 10/2006 |
| JP | 2007-056365 | A | | 3/2007 |
| JP | 2007-100111 | A | | 4/2007 |
| JP | 2008231492 | A | * | 10/2008 |
| JP | 2009242822 | A | * | 10/2009 |
| WO | 00/29632 | A1 | | 5/2002 |
| WO | WO 2010079707 | A1 | * | 7/2010 ..... H01B 1/02 |

OTHER PUBLICATIONS

Notice of Allowance issued in corresponding Japanese National Stage application 2013-502310 drafted on May 27, 2013 and mailed Jun. 4, 2013.

Hall, E.O., "The Deformation and Ageing of Mild Steel: III—Discussion of Results," Proc. Phys. Soc. London, 64 (1951) pp. 747-753.

Petch, N. J., "The Cleavage Stength of Polycrystals," Journal of the Iron and Steel Institute, 174 (1953), p. 25-28.

International Search Report issued in corresponding application PCT/JP2012/073630, completed Nov. 15, 2012 and mailed Dec. 4, 2012.

Notice of Allowance issued in corresponding Japanese application 2013-502309, completed May 27, 2013 and mailed Jun. 4, 2013.

Office Action issued in co-pending related U.S. Appl. No. 14/098,378 on Jul. 9, 2014.

Office Action issued in co-pending related U.S. Appl. No. 14/124,224 on Aug. 21, 2014.

Metals Handbook, Ninth Edition, vol. 14, 1988, pp. 812 to 813.

* cited by examiner

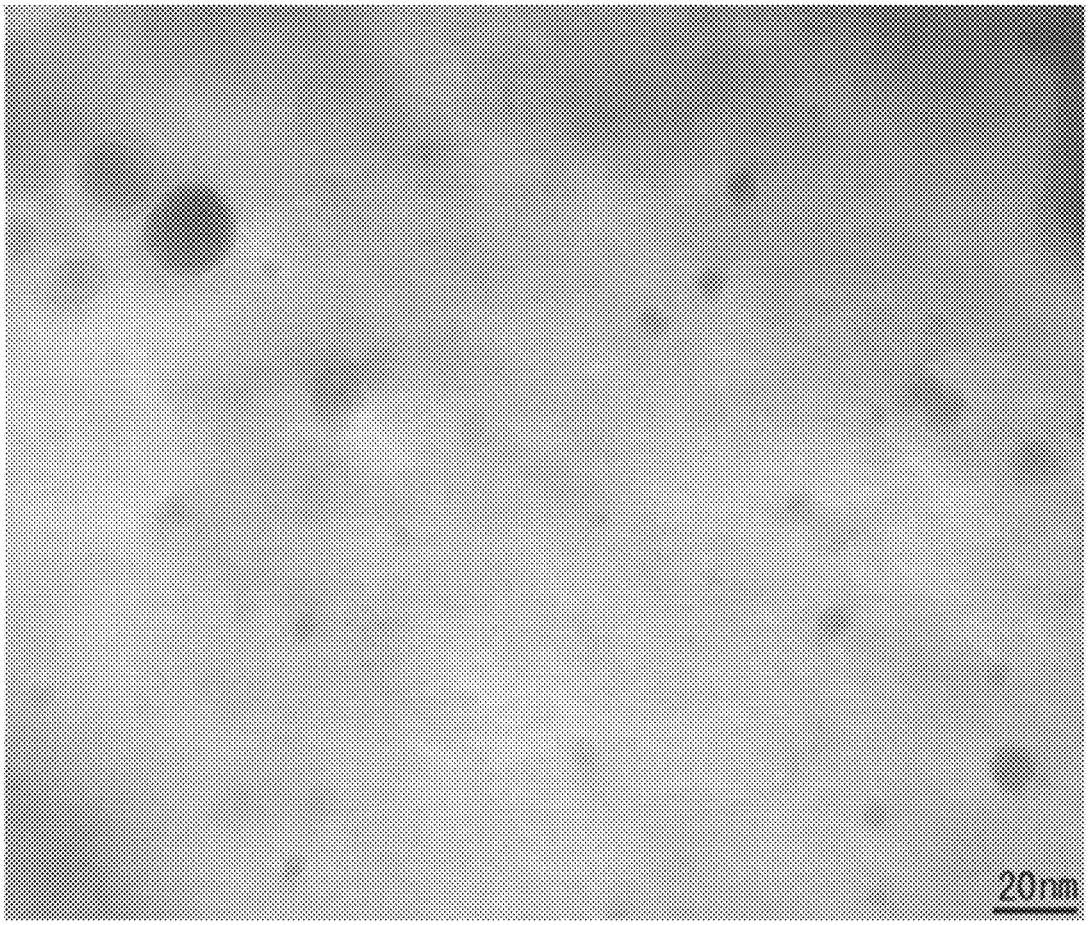
20nm

COPPER ALLOY SHEET AND METHOD FOR MANUFACTURING COPPER ALLOY SHEET

This is a Divisional Application in the United States of International Patent Application No. PCT/JP2012/073630 filed Sep. 14, 2012, which claims priority on Japanese Patent Application No. 2011-203452, filed Sep. 16, 2011. The entire disclosures of the above patent applications are hereby incorporated by reference.

TECHNICAL FIELD

The present invention relates to a copper alloy sheet and a method for manufacturing the copper alloy sheet. The invention particularly relates to a copper alloy sheet that is excellent in terms of tensile strength, proof stress, conductivity, bending workability, stress relaxation characteristics and corrosion resistance, and a method for manufacturing the copper alloy sheet.

BACKGROUND ART

Thus far, a copper alloy sheet having high conduction and high strength has been used for a constituent material of connectors, terminals, relays, springs, switches and the like that have been used in electric components, electronic components, vehicle components, communication devices, electronic and electric devices and the like. However, the recent decreases in the size and weight of the devices and the recent performance enhancement require extremely advanced improvement in the characteristics of constituent materials used in the devices. For example, an extremely thin sheet is used in a spring contact point of a connector, and a high-strength copper alloy that constitutes the extremely thin sheet needs to have high strength or highly balanced elongation and strength in order to decrease the thickness of the sheet. Furthermore, the high-strength copper alloy also needs to have excellent productivity and economic efficiency and to prevent the occurrence of problems in terms of conduction, corrosion resistance (stress corrosion cracking resistance, dezincification corrosion resistance and migration resistance), stress relaxation characteristics, solderability and the like.

In addition, in constituent materials of connectors, terminals, relays, springs, switches and the like that are used in electric components, electronic components, vehicle components, communication devices, electronic and electric devices and the like, there are components and portions which require higher strength or a higher conductivity in order to decrease the thickness with preconditions of excellent elongation and excellent bending workability. However, strength and conductivity are contradictory characteristics, and thus, when strength improves, it is general for conductivity to decrease. Among the above, there are components that are a high-strength material and need to have a higher conductivity (21% IACS or more, for example, approximately 25% IACS) at a tensile strength of 580 $N/mm^2$ or more. In addition, there are components that need to have superior stress relaxation characteristics and superior thermal resistance in a place with a high operation environment temperature such as a place near an engine room in an automobile.

Furthermore, in addition to connectors, terminals, relays and the like, there are component constituent materials of sliding pieces, bushes, bearings and liners which need to have high strength, favorable elongation, balanced strength and elongation, and excellent corrosion resistance, particularly, a variety of clasps that need to have strength, workability and corrosion resistance such as sliding liners in automatic pile drivers, clothing clasps and spring cooler clasps, and a variety of devices for which there are tendencies of size decrease, weight decrease, reliability improvement and performance enhancement such as filters in a variety of strainers.

Generally, beryllium copper, phosphor bronze, nickel silver, brass and Sn-added brass are well known as high strength and high conduction copper alloys, but the ordinary high-strength copper alloys have the following problems, and thus cannot satisfy the above requirements.

Beryllium copper has a highest strength among copper alloys, but beryllium is extremely harmful to human bodies (particularly, in a molten state, even an extremely small amount of beryllium vapor is very dangerous). In addition, the disposal treatment (particularly, incineration treatment) of beryllium copper members or products including beryllium copper members is difficult, and the initial cost necessary for a melting facility used to manufacture beryllium copper becomes extremely high. Therefore, not only is a solution treatment required in the final stage of manufacturing in order to obtain desired characteristics, but there is also a problem with economic efficiency including manufacturing costs.

Since phosphor bronze and nickel silver have poor hot workability and are not easily manufactured through hot rolling, generally, phosphor bronze and nickel silver are manufactured through horizontal continuous casting. Therefore, the productivity is poor, the energy cost is high, and the yield is also poor. In addition, since large amounts of expensive Sn and expensive Ni are contained in phosphor bronze for springs or nickel silver for springs which are representative high-strength products, there is a problem with economic efficiency, and both have poor conductivity.

While brass and Sn-added brass are cheap, they do not have satisfactorily balanced strength and elongation, have poor stress relaxation characteristics, and have a problem with corrosion resistance (stress corrosion and dezincification corrosion resistance), and therefore brass and Sn-added brass are inappropriate as constituent materials for products that need to achieve size decrease, reliability improvement and performance enhancement.

Therefore, the ordinary high conduction and high-strength copper alloys are unsatisfactory as a component constituent material for a variety of devices for which there are tendencies of size decrease, weight decrease, reliability improvement and performance enhancement as described above, and there is a strong demand for development of new high conduction and high-strength copper alloys.

As an alloy for satisfying the above requirements of high conduction, high strength and the like, for example, a Cu—Zn—Sn alloy described in Patent Document 1 is known. However, the alloy according to Patent Document 1 is still insufficient in terms of strength and the like.

RELATED ART DOCUMENT

Patent Document

[Patent Document 1] Japanese Unexamined Patent Application Publication No. 2007-56365

DISCLOSURE OF THE INVENTION

Problem that the Invention is to Solve

The invention has been made to solve the above problems of the related art, and an object of the invention is to provide a copper alloy sheet that is excellent in terms of tensile strength, proof stress, conductivity, bending workability, stress relaxation characteristics and stress corrosion cracking resistance.

Means to Solve the Problems

Paying attention to the Hall-Petch relationship saying that the 0.2% proof stress (which is a strength when the permanent strain reaches 0.2%, and, hereinafter, will be sometimes simply referred to as "proof stress") increases in proportion to the inverse of square root of the crystal grain diameter D ($D^{-1/2}$) (refer to E. O. Hall, Proc. Phys. Soc. London. 64 (1951) 747 and N. J. Petch, J. Iron Steel Inst. 174 (1953) 25.), the present inventors considered that a high-strength copper alloy that can satisfy the above requirements of the times can be obtained by miniaturizing crystal grains, and carried out a variety of studies and experiments regarding the miniaturization of crystal grains.

As a result, the following finding was obtained.

Crystal grains can be miniaturized by recrystallizing a copper alloy in accordance with elements being added. When crystal grains (recrystallized grains) are miniaturized to a certain size or smaller, it is possible to significantly improve strength, mainly tensile strength and proof stress. That is, as the average crystal grain diameter decreases, the strength also increases.

Specifically, a variety of experiments were carried out regarding the influences of elements being added on the miniaturization of crystal grains. Thereby, the following things were clarified.

The addition of Zn and Sn to Cu has an effect that increases the number of nucleation sites of recrystallization nuclei. Furthermore, the addition of P, Ni and, furthermore, Co to a Cu—Zn—Sn alloy has an effect that suppresses grain growth. Therefore, it was clarified that a Cu—Zn—Sn—P—Ni-based alloy having fine crystal grains can be obtained by using the above effect.

That is, a decrease in stacking-fault energy by the addition of Zn and Sn which have divalent and tetravalent atomic valences respectively is considered to be one of the main causes for the increase in the number of nucleation sites of recrystallization nuclei. The suppression of the growth of crystal grains which maintains the generated fine recrystallized grains being fine is considered to result from the growth of fine precipitates by the addition of P and Ni, and, furthermore, Co and Fe. However, the balance among strength, elongation, stress relaxation characteristics and bending workability cannot be obtained simply by ultra-miniaturizing recrystallized grains. It was clarified that miniaturization with a margin of recrystallized grains, that is, the miniaturization of crystal grains in a certain size range is preferable in order to maintain the balance. Regarding the miniaturization or ultra-miniaturization of crystal grains, JIS H 0501 describes the minimum crystal grain size is 0.010 mm in a standard photograph. Based on this description, it is considered that crystal grains can be said to be miniaturized in a copper alloy having an average crystal grain diameter of approximately 0.005 mm or less, and crystal grains can be said to be ultra-miniaturized in a copper alloy having an average crystal grain diameter of approximately 0.0035 mm (3.5 microns) or less.

The invention has been completed based on the above finding by the inventors. That is, the problems can be solved as described below.

The invention provides a copper alloy sheet that is a copper alloy sheet manufactured using a manufacturing process including a cold finishing rolling process in which a copper alloy material is cold-rolled, in which an average crystal grain diameter of the copper alloy material is 1.2 μm to 5.0 μm, round or oval precipitates are present in the copper alloy material, an average grain diameter of the precipitates is 4.0 nm to 25.0 nm or a proportion of precipitates having a grain diameter of 4.0 nm to 25.0 nm in the precipitates is 70% or more, the copper alloy sheet contains 5.0 mass % to 12.0 mass % of Zn, 1.1 mass % to 2.5 mass % of Sn, 0.01 mass % to 0.09 mass % of P and 0.6 mass % to 1.5 mass % of Ni with a remainder of Cu and inevitable impurities, and a content of Zn [Zn] mass %, a content of Sn [Sn] mass %, a content of P [P] mass % and a content of Ni [Ni] mass % have a relationship of $20 \leq [Zn]+7\times[Sn]+15\times[P]+4.5\times[Ni] \leq 32$.

In the invention, cold rolling is carried out on a copper alloy material having crystal grains with a predetermined grain diameter and precipitates with a predetermined grain diameter, but crystal grains and precipitates which are not yet rolled can be identified even after the copper alloy material is cold-rolled. Therefore, it is possible to measure the grain diameter of crystal grains and the grain diameter of precipitates which are still yet to be rolled after rolling. In addition, since the crystal grains and the precipitates still have the same volume even after rolling, the average crystal grain diameter of the crystal grains and the average grain diameter of the precipitates do not change even after cold rolling.

In addition, the round or oval precipitates include not only perfectly round or oval precipitates but also approximately round or oval precipitates.

Furthermore, hereinafter, the copper alloy material will also be appropriately called a rolled sheet.

According to the invention, since the average grain diameter of the crystal grains in the copper alloy material and the average grain diameter of the precipitates which are not yet cold finishing-rolled are within predetermined preferable ranges, the copper alloy is excellent in terms of tensile strength, proof stress, conductivity, bending workability, stress relaxation characteristics, stress corrosion cracking resistance and the like.

In addition, the invention provides a copper alloy sheet that is a copper alloy sheet manufactured using a manufacturing process including a cold finishing rolling process in which a copper alloy material is cold-rolled, in which an average crystal grain diameter of the copper alloy material is 1.2 μm to 5.0 μm, round or oval precipitates are present in the copper alloy material, an average grain diameter of the precipitates is 4.0 nm to 25.0 nm or a proportion of precipitates having a grain diameter of 4.0 nm to 25.0 nm in the precipitates is 70% or more, the copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co and 0.6 mass % to 1.5 mass % of Ni with a remainder of Cu and inevitable impurities, and a content of Zn [Zn] mass %, a content of Sn [Sn] mass %, a content of P [P] mass %, a content of Co [Co] mass % and a content of Ni [Ni] mass % have a relationship of $20 \leq [Zn]+7\times[Sn]+15\times[P]+12\times[Co]+4.5\times[Ni] \leq 32$.

According to the invention, since the average grain diameter of the crystal grains in the copper alloy material and the average grain diameter of the precipitates which are not yet cold finishing-rolled are within predetermined preferable ranges, the copper alloy is excellent in terms of tensile strength, proof stress, conductivity, bending workability, stress relaxation characteristics, stress corrosion cracking resistance and the like.

In addition, when the ratio of Ni to P is $10 \leq [Ni]/[P] \leq 65$, the stress relaxation characteristics become favorable.

In addition, the invention provides a copper alloy sheet that is a copper alloy sheet manufactured using a manufacturing process including a cold finishing rolling process in which a copper alloy material is cold-rolled, in which an average crystal grain diameter of the copper alloy material is 1.2 μm to 5.0 μm, round or oval precipitates are present in the copper alloy material, an average grain diameter of the precipitates is 4.0 nm to 25.0 nm or a proportion of precipitates having a grain diameter of 4.0 nm to 25.0 nm in the precipitates is 70% or more, the copper alloy sheet contains 5.0 mass % to 12.0 mass % of Zn, 1.1 mass % to 2.5 mass % of Sn, 0.01 mass % to 0.09 mass % of P, 0.6 mass % to 1.5 mass % of Ni and 0.004 mass % to 0.04 mass % of Fe with a remainder of Cu and inevitable impurities, and a content of Zn [Zn] mass %, a content of Sn [Sn] mass %, a content of P [P] mass % and a content of Ni [Ni] mass % have a relationship of $20 \leq [Zn]+7\times[Sn]+15\times[P]+4.5\times[Ni] \leq 32$.

According to the invention, the average grain diameter of the crystal grains in the copper alloy material and the average grain diameter of the precipitates which are not yet cold finishing-rolled are within predetermined preferable ranges. Therefore, the copper alloy is excellent in terms of tensile strength, proof stress, conductivity, bending workability, stress relaxation characteristics, stress corrosion cracking resistance and the like. In addition, when the copper alloy sheet contains 0.004 mass % to 0.04 mass % of Fe, crystal grains are miniaturized, and the strength increases.

In addition, the invention provides a copper alloy sheet that is a copper alloy sheet manufactured using a manufacturing process including a cold finishing rolling process in which a copper alloy material is cold-rolled, in which an average crystal grain diameter of the copper alloy material is 1.2 μm to 5.0 μm, round or oval precipitates are present in the copper alloy material, an average grain diameter of the precipitates is 4.0 nm to 25.0 nm or a proportion of precipitates having a grain diameter of 4.0 nm to 25.0 nm in the precipitates is 70% or more, the copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co, 0.6 mass % to 1.5 mass % of Ni and 0.004 mass % to 0.04 mass % of Fe with a remainder of Cu and inevitable impurities, and a content of Zn [Zn] mass %, a content of Sn [Sn] mass %, a content of P [P] mass %, a content of Co [Co] mass % and a content of Ni [Ni] mass % have a relationship of $20 \leq [Zn]+7\times[Sn]+15\times[P]+12\times[Co]+4.5\times[Ni] \leq 32$, and a content of Co [Co] mass % and a content of Fe [Fe] mass % have a relationship of $[Co]+2\times[Fe] \leq 0.08$.

According to the invention, the average grain diameter of the crystal grains in the copper alloy material and the average grain diameter of the precipitates which are not yet cold finishing-rolled are within predetermined preferable ranges. Therefore, the copper alloy is excellent in terms of tensile strength, proof stress, conductivity, bending workability, stress relaxation characteristics, stress corrosion cracking resistance and the like.

In addition, when the ratio of Ni to P is $10 \leq [Ni]/[P] \leq 65$, the stress relaxation characteristics become favorable. Furthermore, when the copper alloy sheet contains 0.004 mass % to 0.04 mass % of Fe, crystal grains are miniaturized, and the strength increases.

In the four copper alloy sheets according to the invention, it is preferable that, when a conductivity is denoted by C (% IACS), a stress relaxation rate is denoted by Sr (%), a tensile strength and an elongation in a direction forming 0 degrees with a rolling direction are denoted by Pw ($N/mm^2$) and L (%) respectively, after the cold finishing rolling process, $C \geq 21$, $Pw \geq 580$, $28500 \leq [Pw\times\{(100+L)/100\}\times C^{1/2}\times(100-Sr)^{1/2}]$, a ratio of a tensile strength in a direction forming 0 degrees with the rolling direction to a tensile strength in a direction forming 90 degrees with the rolling direction be 0.95 to 1.05, and a ratio of a proof stress in a direction forming 0 degrees with the rolling direction to a proof stress in a direction forming 90 degrees with the rolling direction be 0.95 to 1.05.

The strength is high, the corrosion resistance is favorable, the conductivity, the stress relaxation rate, the tensile strength and the elongation are excellently balanced, and the tensile strength and the proof stress are isotropic. Therefore, the copper alloy sheet is appropriate as a constituent material and the like for connectors, terminals, relays, springs, switches, sliding pieces, bushes, bearings, liners, a variety of clasps, filters in a variety of strainers, and the like.

The manufacturing process of the four copper alloy sheets according to the invention preferably includes a recovery thermal treatment process after the cold finishing rolling process.

Since the recovery thermal treatment is carried out, elongation, conductivity, bending workability, isotropy, a spring bending elastic limit, stress relaxation characteristics and the like improve.

In the four copper alloy sheets according to the invention for which the recovery thermal treatment is carried out, it is preferable that, when a conductivity is denoted by C (% IACS), a stress relaxation rate is denoted by Sr (%), a tensile strength and an elongation in a direction forming 0 degrees with a rolling direction are denoted by Pw ($N/mm^2$) and L (%) respectively, $C \geq 21$, $Pw \geq 580$, $28500[Pw\times\{(100+L)/100\}\times C^{1/2}\times(100-Sr)^{1/2}]$, a ratio of a tensile strength in a direction forming 0 degrees with the rolling direction to a tensile strength in a direction forming 90 degrees with the rolling direction be 0.95 to 1.05, and a ratio of a proof stress in a direction forming 0 degrees with the rolling direction to a proof stress in a direction forming 90 degrees with the rolling direction be 0.95 to 1.05.

Since the strength is high, the conductivity, the stress relaxation rate, the tensile strength and the elongation are excellently balanced, and the tensile strength and the proof stress are isotropic, the copper alloy sheet is appropriate as a constituent material and the like for connectors, terminals, relays, springs, switches, and the like.

A method for manufacturing the four copper alloy sheets according to the invention sequentially includes a hot rolling process, a cold rolling process, a recrystallization thermal treatment process and a cold finishing rolling process, in which a hot rolling initial temperature of the hot rolling process is 800° C. to 920° C., a cooling rate of a copper alloy material in a temperature range from a temperature after final rolling to 350° C. or 650° C. to 350° C. is 1° C./second or more, a cold working rate in the cold rolling process is 55% or more, the recrystallization thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, and, in the recrystallization thermal treatment process, when a peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), $540 \leq Tmax \leq 780$, $0.04 \leq tm \leq 2$, and $450 \leq \{Tmax-40\times tm^{-1/2}-50\times(1-RE/100)^{1/2}\} \leq 580$.

Further, depending on the sheet thickness of the copper alloy sheet, a pair of the cold rolling process and an annealing process may be carried out once or plural times between the hot rolling process and the cold rolling process.

A method for manufacturing the four copper alloy sheets according to the invention in which a recovery thermal treatment is carried out sequentially includes a hot rolling process, a cold rolling process, a recrystallization thermal treatment process, a cold finishing rolling process and a recovery thermal treatment process, in which a hot rolling initial temperature of the hot rolling process is 800° C. to 920° C., a cooling rate of a copper alloy material in a temperature range from a temperature after final rolling to 350° C. or 650° C. to 350° C. is 1° C./second or more, a cold working rate in the cold rolling process is 55% or more, the recrystallization thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, in the recrystallization thermal treatment process, when a peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), $540 \leq Tmax \leq 780$, $0.04 \leq tm \leq 2$, and $450 \leq \{Tmax-40 \times tm^{-1/2}-50 \times (1-RE/100)^{1/2}\} \leq 580$, the recovery thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, and, in the recovery thermal treatment process, when a peak temperature of the copper alloy material is denoted by Tmax2 (° C.), a holding time in a temperature range of a temperature 50° C. lower than the peak temperature of the copper alloy material to the peak temperature is denoted by tm2 (min), and the cold working rate in the cold rolling step is denoted by RE2(%), $160 \leq Tmax2 \leq 650$, $0.02 \leq tm2 \leq 200$, and $100 \leq \{Tmax2-40 \times tm2^{-1/2}-50 \times (1-RE2/100)^{1/2}\} \leq 360$.

Further, depending on the sheet thickness of the copper alloy sheet, a pair of the cold rolling process and an annealing process may be carried out once or plural times between the hot rolling process and the cold rolling process.

Advantage of the Invention

According to the invention, the copper alloy sheet is excellent in terms of tensile strength, proof stress, conductivity, bending workability, stress relaxation characteristics, stress corrosion cracking resistance and the like.

BRIEF DESCRIPTION OF THE DRAWINGS

FIG. 1 is a transmission electron microscopic photograph of a copper alloy sheet in Test No. N1 (Alloy No. 9 and Step A1).

BEST MODE FOR CARRYING OUT THE INVENTION

Copper alloy sheets according to embodiments of the invention will be described.

In the present specification, when indicating alloy compositions, a chemical symbol in parenthesis, such as [Cu], is considered to indicate the content value (mass %) of the corresponding element. Also, in the specification, a plurality of computation formulae will be proposed using the above method of indicating the content value. However, a content of Co of 0.005 mass % or less has little influence on the characteristics of the copper alloy sheet. Therefore, in the respective computation formulae described below, the content of Co of 0.005 mass % or less will be considered as 0 in computation.

In addition, each inevitable impurity also has little influence on the characteristics of the copper alloy sheet at its content as an inevitable impurity, and therefore the inevitable impurity will not be included in the respective computation formulae described below. For example, 0.01 mass % or less of Cr will be considered as an inevitable impurity.

In addition, in the specification, as an index that indicates the balance among the contents of Zn, Sn, P, Co and Ni, a composition index f1 will be specified as follows.

Composition Index $$f1=[Zn]+7\times[Sn]+15\times[P]+12\times[Co]+4.5\times[Ni]$$

In addition, in the specification, as an index that indicates the thermal treatment conditions in the recrystallization thermal treatment process and the recovery thermal treatment process, a thermal treatment index It will be specified as follows.

When the peak temperatures of the copper alloy material during the respective thermal treatments are denoted by Tmax (° C.), the holding time in a temperature range of a temperature 50° C. lower than the peak temperature of the copper alloy material to the peak temperature is denoted by tm (min), and the cold working rate of cold rolling carried out between each of the thermal treatments (the recrystallization thermal treatment process or the recovery thermal treatment process) and a process accompanying recrystallization which is carried out before each of the thermal treatments (hot rolling or thermal treatment) is denoted by RE (%), the thermal treatment index It will be specified as follows.

Thermal Treatment Index $$It=Tmax-40\times tm^{-1/2}-50\times(1-RE/100)^{1/2}$$

In addition, as an index that indicates the balance among conductivity, tensile strength and elongation, a balance index f2 will be specified as follows.

When the conductivity is denoted by C (% IACS), the tensile strength is denoted by Pw ($N/mm^2$), and the elongation is denoted by L (%), the balance index f2 will be specified as follows.

Balance Index $$f2=Pw\times\{(100+L)/100\}\times C^{1/2}.$$

In addition, as an index that indicates the balance among conductivity, stress relaxation rate, tensile strength and elongation, a stress relaxation balance index f3 will be specified as follows.

When the conductivity is denoted by C (% IACS), the stress relaxation rate is denoted by Sr (%), the tensile strength is denoted by Pw ($N/mm^2$) and the elongation is denoted by L (%), the stress relaxation balance index f3 will be specified as follows.

Stress Relaxation Balance Index $$f3=[Pw\times\{(100+L)/100\}\times C^{1/2}\times(100-Sr)^{1/2}]$$

The copper alloy sheet according to a first embodiment is obtained through the cold finishing rolling of a copper alloy material. The average crystal grain diameter of the copper alloy material is 1.2 μm to 5.0 μm. Round or oval precipitates are present in the copper alloy material, and the average grain diameter of the precipitates is 4.0 nm to 25.0 nm or the proportion of precipitates having a grain diameter of 4.0 nm to 25.0 nm in the precipitates is 70% or more. In addition, the copper alloy sheet contains 5.0 mass % to 12.0 mass % of Zn, 1.1 mass % to 2.5 mass % of Sn, 0.01 mass % to 0.09 mass % of P and 0.6 mass % to 1.5 mass % of Ni with a remainder of Cu and inevitable impurities. The content of Zn [Zn] mass %, the content of Sn [Sn] mass %, the content of P [P] mass % and the content of Ni [Ni] mass % have a relationship of $20 \leq [Zn]+7\times[Sn]+15\times[P]+4.5\times[Ni] \leq 32$.

In the copper alloy sheet, since the average grain diameter of the crystal grains in the copper alloy material and the average grain diameter of the precipitates which are not yet cold-rolled are within predetermined preferable ranges, the copper alloy is excellent in terms of tensile strength, proof stress, conductivity, bending workability, stress relaxation characteristics, stress corrosion cracking resistance and the like.

The copper alloy sheet according to a second embodiment is obtained through the cold finishing rolling of a copper alloy material. The average crystal grain diameter of the copper alloy material is 1.2 μm to 5.0 μm. Round or oval precipitates are present in the copper alloy material, and the average grain diameter of the precipitates is 4.0 nm to 25.0 nm or the proportion of precipitates having a grain diameter of 4.0 nm to 25.0 nm in the precipitates is 70% or more. The copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co and 0.6 mass % to 1.5 mass % of Ni with a remainder of Cu and inevitable impurities. The content of Zn [Zn] mass %, the content of Sn [Sn] mass %, the content of P [P] mass %, the content of Co [Co] mass % and the content of Ni [Ni] mass % have a relationship of $20 \leq [Zn]+7\times[Sn]+15\times[P]+12\times[Co]+4.5\times[Ni] \leq 32$.

In the copper alloy sheet, since the average grain diameter of the crystal grains in the copper alloy material and the average grain diameter of the precipitates which are not yet cold-rolled are within predetermined preferable ranges, the copper alloy is excellent in terms of tensile strength, proof stress, conductivity, bending workability, stress relaxation characteristics, stress corrosion cracking resistance and the like. In addition, when the ratio of Ni to P is $10 \leq [Ni]/[P] \leq 65$, the stress relaxation characteristics become favorable.

The copper alloy sheet according to a third embodiment is obtained through the cold finishing rolling of a copper alloy material. The average crystal grain diameter of the copper alloy material is 1.2 μm to 5.0 μm. Round or oval precipitates are present in the copper alloy material, and the average grain diameter of the precipitates is 4.0 nm to 25.0 nm or the proportion of precipitates having a grain diameter of 4.0 nm to 25.0 nm in the precipitates is 70% or more. The copper alloy sheet contains 5.0 mass % to 12.0 mass % of Zn, 1.1 mass % to 2.5 mass % of Sn, 0.01 mass % to 0.09 mass % of P, 0.6 mass % to 1.5 mass % of Ni and 0.004 mass % to 0.04 mass % of Fe with a remainder of Cu and inevitable impurities. The content of Zn [Zn] mass %, the content of Sn [Sn] mass %, the content of P [P] mass % and the content of Ni [Ni] mass % have a relationship of $20 \leq [Zn]+7\times[Sn]+15\times[P]+4.5\times[Ni] \leq 32$.

In the copper alloy sheet, since the average grain diameter of the crystal grains in the copper alloy material and the average grain diameter of the precipitates which are not yet cold-rolled are within predetermined preferable ranges, the copper alloy is excellent in terms of tensile strength, proof stress, conductivity, bending workability, stress relaxation characteristics, stress corrosion cracking resistance and the like. In addition, when the copper alloy sheet contains 0.004 mass % to 0.04 mass % of Fe, crystal grains are miniaturized, and the strength increases.

The copper alloy sheet according to a fourth embodiment is obtained through the cold finishing rolling of a copper alloy material. The average crystal grain diameter of the copper alloy material is 1.2 μm to 5.0 μm. Round or oval precipitates are present in the copper alloy material, and the average grain diameter of the precipitates is 4.0 nm to 25.0 nm or the proportion of precipitates having a grain diameter of 4.0 nm to 25.0 nm in the precipitates is 70% or more. The copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co, 0.6 mass % to 1.5 mass % of Ni and 0.004 mass % to 0.04 mass % of Fe with a remainder of Cu and inevitable impurities. The content of Zn [Zn] mass %, the content of Sn [Sn] mass %, the content of P [P] mass %, the content of Co [Co] mass % and the content of Ni [Ni] mass % have a relationship of $20 \leq [Zn]+7\times[Sn]+15\times[P]+12\times[Co]+4.5\times[Ni] \leq 32$, and a content of Co [Co] mass % and a content of Fe [Fe] mass % have a relationship of $[Co]+2\times[Fe] \leq 0.08$.

In the copper alloy sheet, since the average grain diameter of the crystal grains in the copper alloy material and the average grain diameter of the precipitates which are not yet cold-rolled are within predetermined preferable ranges, the copper alloy is excellent in terms of tensile strength, proof stress, conductivity, bending workability, stress relaxation characteristics, stress corrosion cracking resistance and the like. In addition, when the copper alloy sheet contains 0.004 mass % to 0.04 mass % of Fe, crystal grains are miniaturized, and the strength increases. Furthermore, when the ratio of Ni to P is $10 \leq [Ni]/[P] \leq 65$, the stress relaxation characteristics become favorable.

Preferable ranges of the crystal grain diameter of the crystal grains and the average grain diameter of the precipitates will be described below.

Next, a preferable process for manufacturing the copper alloy sheets according to the present embodiments will be described.

The manufacturing process sequentially includes a hot rolling process, a first cold rolling process, an annealing process, a second cold rolling process, a recrystallization thermal treatment process and the cold finishing rolling process. The second cold rolling process corresponds to a cold rolling process described in the claims. Ranges of necessary manufacturing conditions will be set for the respective processes, and the ranges will be called set condition ranges.

Regarding the composition of an ingot used in hot rolling, the composition of the copper alloy sheet contains 5.0 mass % to 12.0 mass % of Zn, 1.1 mass % to 2.5 mass % of Sn, 0.01 mass % to 0.09 mass % of P and 0.6 mass % to 1.5 mass % of Ni with a remainder of Cu and inevitable impurities, and is adjusted so that the composition index f1 is within a range of $20 \leq f1 \leq 32$. An alloy with the above composition will be called a first invention alloy.

In addition, regarding the composition of an ingot used in hot rolling, the composition of the copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co and 0.6 mass % to 1.5 mass % of Ni with a remainder of Cu and inevitable impurities, and is adjusted so that the composition index f1 is within a range of $20 \leq f1 \leq 32$. An alloy with the above composition will be called a second invention alloy.

In addition, regarding the composition of an ingot used in hot rolling, the composition of the copper alloy sheet contains 5.0 mass % to 12.0 mass % of Zn, 1.1 mass % to 2.5 mass % of Sn, 0.01 mass % to 0.09 mass % of P, 0.6 mass % to 1.5 mass % of Ni and 0.004 mass % to 0.04 mass % of Fe with a remainder of Cu and inevitable impurities, and is adjusted so that the composition index f1 is within a range of $20 \leq f1 \leq 32$. An alloy with the above composition will be called a third invention alloy.

In addition, regarding the composition of an ingot used in hot rolling, the composition of the copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co, 0.6 mass % to 1.5 mass % of Ni and 0.004 mass % to 0.04 mass % of Fe with a remainder of Cu and inevitable impurities, and is adjusted so that the composition index f1 is within a range of $20 \leq f1 \leq 32$, and a content of Co [Co] mass % and a content of Fe [Fe] mass % have a relationship of $[Co]+2\times[Fe] \leq 0.08$. An alloy with the above composition will be called a fourth invention alloy.

The first invention alloy, the second invention alloy, the third invention alloy and the fourth invention alloy will be collectively called invention alloys.

In the hot rolling process, the hot rolling initial temperature is 800° C. to 920° C., and the cooling rate of a rolled material in a temperature range from a temperature after final rolling to 350° C. or 650° C. to 350° C. is 1° C./second or more.

In the first cold rolling process, the cold working rate is 55% or more.

The annealing process has conditions that satisfy $D0 \leq D1 \times 4 \times (RE/100)$ when the crystal grain diameter after the recrystallization thermal treatment process is denoted by D1, the crystal grain diameter before the recrystallization thermal treatment process and after the annealing process is denoted by D0, and the cold working rate of the second cold rolling between the recrystallization thermal treatment process and the annealing process is denoted by RE (%) as described below. The conditions are that, for example, in a case in which the annealing process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, when a peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the first cold rolling step is denoted by RE (%), $400 \leq Tmax \leq 800$, $0.04 \leq tm \leq 600$, and $370 \leq \{Tmax - 40 \times tm^{-1/2} - 50 \times (1 - RE/100)^{1/2}\} 580$.

The first cold rolling process and the annealing process may not be carried out in a case in which the sheet thickness of the rolled sheet after cold finishing rolling is thick, and the first cold rolling process and the annealing process may be carried out plural times in a case in which the sheet thickness is thin. Whether or not the first cold rolling process and the annealing process are carried out or the number of times of the first cold rolling process and the annealing process are determined by the relationship between the sheet thickness after the hot rolling process and the sheet thickness after the cold finishing rolling process.

In the second cold rolling process, the cold working rate is 55% or more.

The recrystallization thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step.

Here, when the peak temperature of the copper alloy material is denoted by Tmax (° C.), and the holding time in a temperature range of a temperature 50° C. lower than the peak temperature of the copper alloy material to the peak temperature is denoted by tm (min), the recrystallization thermal treatment satisfies the following conditions.

(1) 540≤peak temperature Tmax≤780

(2) 0.04≤holding time tm≤2

(3) 450≤thermal treatment index It≤580

There are also cases in which a recovery thermal treatment process described below is carried out after the recrystallization thermal treatment process, but the recrystallization thermal treatment process becomes the final thermal treatment in which the copper alloy material is recrystallized.

After the recrystallization thermal treatment process, the copper alloy material has a metallic structure in which the average crystal grain diameter is 1.2 μm to 5.0 μm, round or oval precipitates are present, the average grain diameter of the precipitates is 4.0 nm to 25.0 nm or the proportion of precipitates having a grain diameter of 4.0 nm to 25.0 nm in the precipitates is 70% or more.

In the cold finishing rolling process, the cold working rate is 10% to 60%.

The recovery thermal treatment process may be carried out after the cold finishing rolling process. In addition, since the copper alloy of the invention is plated with Sn after finishing rolling for use, and the temperature of the material increases during plating such as molten Sn plating or reflow Sn plating, it is possible to replace the recovery thermal treatment process with a heating process during the plating treatment.

The recovery thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step.

Here, when the peak temperature of the copper alloy material is denoted by Tmax (° C.), and the holding time in a temperature range of a temperature 50° C. lower than the peak temperature of the copper alloy material to the peak temperature is denoted by tm (min), the recovery thermal treatment process satisfies the following conditions.

(1) 160≤peak temperature Tmax≤650

(2) 0.02≤holding time tm≤200

(3) 100≤thermal treatment index It≤360

Next, the reasons for adding the respective elements will be described.

Zn is an important element that configures the invention, has a divalent atomic valence, decreases the stacking-fault energy, increases the number of generation sites of recrystallization nuclei during annealing, and miniaturizes or ultra-miniaturizes recrystallized grains. In addition, the formation of a solid solution of Zn improves strength such as tensile strength or proof stress, improves the thermal resistance of the matrix, improves the stress relaxation characteristics, and improves the migration resistance. Zn also has economic merits of a cheap metal cost and a decrease in the specific gravity of the copper alloy. While the relationship with other elements being added, such as Sn, also has an influence, in order to exhibit the above effects, it is necessary that Zn be contained at at least 5.0 mass % or more, preferably 5.5 mass % or more, and optimally 6.0 mass % or more. On the other hand, while the relationship with other elements being added, such as Sn, also has an influence, even when more than 12.0 mass % of Zn is contained, regarding the miniaturization of crystal grains and the improvement of the strength, the exhibition of the significant effects commensurate with the content begins to stop such that the conductivity decreases, the elongation and the bending workability deteriorate, the thermal resistance and the stress relaxation characteristics degrade, and the sensitivity of stress corrosion cracking resistance increases. The content of Zn is more preferably 11.0 mass % or less, and optimally 10.0 mass % or less. Even when the content of Zn having a divalent atomic valence is within the above range, if Zn is solely added, it is difficult to miniaturize crystal grains, and therefore, in order to miniaturize crystal grains to a predetermined grain diameter, it is necessary to add Zn together with Sn described below and to consider the value of the composition index f1.

Sn is an important element that configures the invention, has a tetravalent atomic valence, decreases the stacking-fault energy, increases the number of generation sites of recrystallization nuclei during annealing in cooperation with Zn being contained, and miniaturizes or ultra-miniaturizes recrystallized grains. The effect of Sn, that miniaturizes crystal grains, being contained is significantly exhibited when Sn is added together with 5.0 mass % or more, preferably, 5.5 mass % or more of divalent Zn. In addition, Sn forms a solid solution in the matrix, which improves tensile strength, proof stress and the like, and also improves the migration resistance, the stress relaxation characteristics, the thermal resistance and stress corrosion cracking resistance. In order to exhibit the above effects, it is necessary that Sn be contained at at least 1.1 mass % or more, preferably 1.2 mass % or more, and optimally 1.5 mass % or more. On the other hand, a large amount of Sn being contained impairs the hot rolling property, deteriorates the conductivity, and deteriorates stress corrosion cracking resistance, stress relaxation characteristics and thermal resistance. While the value of f1 or the relationship with other elements, such as Zn, also has an influence, if the content of Sn exceeds 2.5 mass %, a high conductivity of 21% IACS or more that is approximately ⅕ or more of the conductivity of pure copper cannot be obtained. The content of Sn is preferably 2.4 mass % or less, and optimally 2.2 mass % or less.

Cu is a major element that configures the invention alloys, and thus is treated as a remainder. However, in order to ensure the conductivity and the stress corrosion cracking resistance which are dependent on the concentration of Cu, and to hold favorable stress relaxation characteristics and elongation for achieving the invention, it is necessary that Cu be contained at at least 85 mass % or more, and preferably in 86 mass % or more. On the other hand, in order to miniaturize crystal grains and to obtain high strength, the content of Cu is set to at least 93 mass % or less, and preferably to 92 mass % or less.

P has a pentavalent atomic valence, an action that miniaturizes crystal grains, an action that suppresses the growth of recrystallized grains and an action that improves the stress relaxation characteristics; however, since the content of P is small, the action that suppresses the growth of recrystallized grains and the action that improves the stress relaxation characteristics are large. The action that improves the stress relaxation characteristics and the action that suppresses the growth of recrystallized grains cannot be sufficient when P is solely contained, and the actions can be exhibited when P is added together with Ni, Sn or Co. Some of P can bond with Ni described below and Co so as to form precipitates, can suppress the growth of recrystallized grains, and can improve the stress relaxation characteristics. In order to suppress the growth of recrystallized grains, round and oval precipitates need to be present, the average grain diameter of the precipitates needs to be 4 nm to 25 nm or the proportion of precipitated grains having a grain diameter of 4.0 nm to 25.0 nm in precipitated grains needs to be 70% or more. Precipitates belonging to the above range have a large action or effect that suppresses the growth of recrystallized grains during annealing due to precipitation strengthening which is differentiated from a strengthening action that is caused simply by precipitation. In addition, the remaining P in a solid solution state improves the stress relaxation characteristics by the synergetic effect of the coexistence of elements that form solid solutions, such as Ni, Sn and Zn, particularly Ni.

In order to exhibit the above effect, the content of P needs to be at least 0.010 mass % or more, preferably 0.015 mass % or more, and optimally 0.025 mass % or more. On the other hand, even when more than 0.090 mass % of P is contained, the effect that improves the stress relaxation characteristics by the co-addition with Ni, the effect that suppresses the growth of recrystallized grains by precipitates and the effect that improves the stress relaxation characteristics are saturated, and, conversely, when precipitates are excessively present, elongation and bending workability degrade. The content of P is preferably 0.070 mass % or less, and optimally 0.060 mass % or less.

Some of Ni bonds with P or bonds with P and Co so as to form a compound, and the majority of Ni forms a solid solution. Ni improves the stress relaxation characteristics of the alloy, increases the Young's modulus of the alloy, improves the thermal resistance, and suppresses the growth of recrystallized grains. In order to improve the stress relaxation characteristics and the Young's modulus, and to exhibit the action that suppresses the growth of recrystallized grains, the amount of Ni needs to be 0.6 mass % or more. Particularly, in order to improve the stress relaxation characteristics and the Young's modulus, the content of Ni is preferably 0.7 mass %, and optimally 0.8 mass % or more. On the other hand, when Ni is excessively contained, the conductivity is impaired, and the stress relaxation characteristics are also saturated, and therefore the upper limit of the content of Ni is 1.5 mass % or less, and preferably 1.3 mass % or less. In addition, the action of Ni that improves the stress relaxation characteristics is exhibited by the co-addition of P, Zn and Sn; however, in the relationships with Sn and Zn, it is preferable that the relational formula of the composition described below be satisfied and, in particular, the content of Ni, for convenience, satisfy the following relational formula E1 in order to improve stress relaxation characteristic, the Young's modulus and thermal resistance.

$$0.05\times([Zn]-3)+0.25\times([Sn]-0.3)\leq[Ni]$$

Here, the upper limit of the content of Ni is 1.5 mass % or less.

When Zn and Sn are added to Cu, stress relaxation characteristics and thermal resistance significantly improve. However, the effect begins to be saturated at a concentration of Zn of 3 mass % and a concentration of Sn of 0.3 mass %. When Ni is contained at more than the sum of a Zn-related term obtained by subtracting 3 mass % from the content of Zn and then multiplying the value by an experimentally-obtained coefficient and a Sn-related term obtained by subtracting 0.3 mass % from the content of Sn and then multiplying the value by an experimentally-obtained coefficient, the invention can have more favorable stress relaxation characteristics and more favorable thermal resistance.

That is, in the formula of $0.05\times([Zn]-3)+0.25\times([Sn]-0.3)\leq[Ni]$, when Ni is contained at or more than the sum of the Zn-related term 0.05×([Zn]−3) and the Sn-related term 0.25×([Sn]−0.3), the stress relaxation characteristics particularly improve.

It is more preferable that the following relational formula E2 be satisfied.

$$0.05\times([Zn]-3)+0.25\times([Sn]-0.3)\leq[Ni]/1.2$$

It is optimal that the following relational formula E3 be satisfied.

$$0.05\times([Zn]-3)+0.25\times([Sn]-0.3)\leq[Ni]/1.4$$

Meanwhile, in order to improve the stress relaxation characteristics and to exhibit the action that suppresses the growth of crystal grains, the mixing ratio between Ni and P is also important, and [Ni]/[P] is preferably 10 or more. In order to particularly improve the stress relaxation characteristics, since the amount of Ni that forms a solid solution needs to be sufficient compared with the amount of P, [Ni]/[P] is preferably 12 or more, and optimally 15 or more. Regarding the upper limit, since the stress relaxation characteristics deteriorate when the amount of P that forms a solid solution is small compared with the amount of Ni, [Ni]/[P] is 65 or less, preferably 50 or less, and optimally 40 or less.

Some of Co bonds with P or bonds with P and Ni so as to form a compound, and the remaining forms a solid solution. Co suppresses the growth of recrystallized grains, and improves stress relaxation characteristics. Co being contained plays a role of preventing hot rolling cracking in a case in which a large amount of Sn is contained. Co has a large effect that suppresses the growth of crystal grains in an amount slightly smaller than the content of Ni. In order to exhibit the effect, it is necessary that Co be contained at 0.005 mass % or more, and preferably 0.010 mass % or more. On the other hand, even when 0.09 mass % or more of Co is contained, the effect becomes saturated, the conduction degrades depending on a manufacturing process, a number of fine precipitates are generated, conversely, the mechanical properties are likely to be anisotropic, and the stress relaxation characteristics also degrade. The content of Co is preferably 0.04 mass % or less, and optimally 0.03 mass % or less.

In order to further exhibit the effect of Co that suppresses the growth of crystal grains and to suppress the degradation of the conductivity to the minimum extent, [Co]/[P] is 0.15 or more, and preferably 0.2 or more. On the other hand, the upper limit is 1.5 or less, and preferably 1.0 or less.

Meanwhile, in order to obtain balanced strength and elongation, high strength and high conduction, it is necessary to consider not only the mixing amounts of Zn, Sn, P, Co and Ni but also the correlations between the respective elements. While the stacking-fault energy can be decreased by Zn having a divalent atomic valence and Sn having a tetravalent atomic valence being contained, both of which are added in a large amount, the miniaturization of crystal grains by the synergetic effect of P, Co and Ni being contained, the balance between strength and elongation, the difference in strength and elongation between in a direction forming 0 degrees and in a direction forming 90 degrees with the rolling direction, conductivity, stress relaxation characteristics, stress corrosion cracking resistance and the like should be taken into consideration. It was clarified by the inventors' studies that the respective elements needs to satisfy $20\leq[Zn]+7[Sn]+15[P]+12[Co]+4.5[Ni]\leq32$ with the ranges of the contents of the invention alloys. When the relationship is satisfied, a material having high conduction, high strength, high elongation, and highly balanced characteristics can be obtained. (Composition index $f1=[Zn]+7\times[Sn]+15\times[P]+12\times[Co]+4.5\times[Ni]$).

That is, in order for a final rolled material to have high conduction with a conductivity of 21% IACS or more, favorable strength with a tensile strength of 580 N/mm$^2$ or more, a small average crystal grain diameter, favorable stress relaxation characteristics, slightly anisotropic strength and favorable elongation, it is necessary to satisfy $20\leq f1\leq32$. In $20\leq f1\leq32$, the lower limit particularly affects the miniaturization of crystal grains and high strength (the higher, the better), and is preferably 20.5 or more, and optimally 21 or more. In addition, the upper limit particularly affects conduction, stress relaxation characteristics, bending workability, stress corrosion cracking resistance and the isotropy of strength (the smaller, the better), and is preferably 30.5 or less, more preferably 29.5 or less, and optimally 28.5 or less. Regarding the stress relaxation characteristics, it is preferable that the content of Ni be large, the value of f1 be 20 to 29.5, more preferably, 28.5 or less, and the relational formula E1 or the relational formula $[Ni]/[P]\geq10$ be satisfied as described above. When the amounts of the respective elements and the relational formulae between the elements are managed in narrower ranges, a rolled material obtains a higher degree of balance. Meanwhile, the target member of the present case does not particularly require an upper limit of the conductivity of higher than 32% IACS or 31% IACS, is advantageously a member having high strength and excellent stress relaxation characteristics, and there are cases in which an excessively high conductivity causes disadvantages since, sometimes, spot welding is carried out on the member.

Meanwhile, regarding the ultra-miniaturization of crystal grains, it is possible to ultra-miniaturize recrystallized grains to 1 μm in an alloy in the composition range of the invention alloys. However, when crystal grains in the present alloy are miniaturized to 1 μm, the proportion of crystal grain boundaries formed in a width of approximately several atoms increases, elongation, bending workability and stress relaxation characteristics deteriorate, and the strength becomes anisotropic. Therefore, in order to have high strength and high elongation, the average crystal grain diameter needs to be 1.2 μm or more, is more preferably 1.5 μm or more, and optimally 1.8 μm or more. On the other hand, as the size of crystal grains increases, more favorable elongation appears, but desired tensile strength and desired proof stress cannot be obtained, and the strength becomes anisotropic. At least, it is necessary to decrease the average crystal grain diameter to 5.0 μm or less. The average crystal grain diameter is more preferably 4.0 μm or less, still more preferably 3.5 μm or less. When crystal grains are fine, atomic diffusion becomes easy, and stress relaxation characteristics commensurate with the degree of the improvement of the strength are exhibited; however, conversely, when crystal grains are too fine, the stress relaxation characteristics deteriorate. Therefore, in order to exhibit favorable stress relaxation characteristics, the average crystal grain diameter is preferably 1.8 μm or more, and more preferably 2.4 μm or more. The upper limit of the average crystal grain diameter is 5.0 μm or less, and more preferably 4.0 μm or less in consideration of the strength. As such, when the average crystal grain diameter is set in a narrower range, it is possible to obtain excellently balanced ductility, strength, conduction and stress relaxation characteristics.

Meanwhile, for example, when a rolled material that has been cold-rolled at a cold working rate of 55% or more is annealed, while the time also has an effect, if the temperature exceeds a certain threshold temperature, recrystallization nuclei are generated mainly in crystal grain boundaries in which process strain is accumulated. While the alloy composition also has an effect, in the case of the present invention alloy, recrystallized grains generated after nucleation are recrystallized grains with a grain diameter of 1 μm or less; however, even when heat is added to the rolled material, the entire processed structure does not change into recrystallized grains at once. In order for all or the majority, for example, 97% of the processed structure to change into recrystallized grains, a temperature higher than the temperature at which the nucleation for recrystallization begins and a time longer than the time in which the nucleation for recrystallization begins are required. During the annealing, the initially-generated recrystallized crystal grains grow as the temperature and the time increase, and the crystal grain diameter increases. In order to maintain a small diameter of recrystallized grains, it is necessary to suppress the growth of recrystallized grains. In order to achieve the object, P, Ni and, furthermore, Co are contained. In order to suppress the growth of recrystallized grains, things such as pins that suppress the growth of recrystallized grains are required, and, in the invention alloy, the equivalent of the pin is a compound made up of P, Ni and, furthermore, Co or Fe described below, and the compound is an optimal thing for playing a role of the pin. In order for the compound to play a role of the pin, the properties of the compound and the grain diameter of the compound are important. That is, it was found from the study results that, basically, the compound made up of P, Ni and, furthermore, Co or the like does not frequently impair elongation, and, particularly, when the grain diameter of the compound is 4 nm to 25 nm, elongation is rarely impaired, and the growth of crystal grains is effectively suppressed.

In addition, it was clarified from the properties of the compound that [Ni]/[P] is preferably 10 or more, and, when [Ni]/[P] exceeds 12, furthermore, 15, the stress relaxation characteristics improve. Meanwhile, in a case in which P and Ni are added together, the diameters of the precipitates being formed are as large as 6 nm to 25 nm. In a case in which P and Ni are added together, the effect that suppresses the growth of crystal grains becomes small, but the influence on elongation is small. In a case in which P, Ni and Co are added together, the average grain diameter of precipitates is 4 nm to 20 nm, and the diameters of precipitated grains increase as the content of Ni increases. In addition, in a case in which P and Ni are added together, the bonding state of the precipitates is considered to be mainly $Ni_3P$ or $Ni_2P$, and, in the case in which P, Ni and Co are added together, the bonding state of the precipitates is considered to be mainly $Ni_xCo_yP$ (x and y change depending on the contents of Ni and Co).

The properties of precipitates are important, and a combination of P, Ni and, furthermore, Co is optimal; however, for example, Mn, Mg, Cr or the like also form a compound with P, and, when a certain amount or more of the elements are included, there is a concern that elongation may be impaired. Therefore, it is necessary to manage the elements such as Cr at a concentration at which the elements do not have any influence. In the invention, Fe can be used in the same manner as Co and Ni, particularly, Co. That is, when 0.004 mass % or more of Fe is contained, a Fe—Ni—P compound or a Fe—Ni—Co—P compound is formed, similarly to Co, the effect that suppresses the growth of crystal grains is exhibited, and the strength is improved. However, the compound being formed is smaller than a Ni—P compound or a Ni—Co—P compound. It is necessary to satisfy a condition of the average grain diameter of the precipitates being 4.0 nm to 25.0 nm or a proportion of precipitates having a grain diameter of 4.0 nm to 25.0 nm in the precipitates being 70% or more. Therefore, the upper limit of Fe is 0.04 mass %, preferably 0.03 mass %, and optimally 0.02 mass %. When Fe is contained in the combination of P—Ni or P—Co—Ni, the form of the compound becomes P—Ni—Fe or P—Co—Ni—Fe. Here, in a case in which Co is contained, the sum of the content of Co and double the content of Fe needs to be 0.08 mass % or less (that is, $[Co]+2\times[Fe]\leq 0.08$). The sum of the content of Co and double the content of Fe is preferably 0.05 mass % or less (that is, $[Co]+2\times[Fe]\leq 0.05$), and optimally 0.04 mass % or less (that is, $[Co]+2\times[Fe]\leq 0.04$). When the concentration of Fe is managed in a more preferable range, a material having particularly high strength, high conduction, favorable bending workability and favorable stress relaxation characteristics is obtained.

Therefore, Fe can be effectively used in order to achieve the object of the application.

There needs to be 0.03 mass % or less of elements that bond with P except for Ni, Co and Fe, such as Cr, Mn and Mg, and preferably 0.02 mass % or less respectively, or there needs to be 0.04 mass % or less of the total content of the elements that bond with P except for Ni, Co and Fe, such as Cr. Changes in the composition and structure of precipitates have a large influence on elongation.

As an index that indicates an alloy having highly balanced strength, elongation and conduction, the product thereof can be used for evaluation. When the conductivity is denoted by C (% IACS), the tensile strength is denoted by Pw ($N/mm^2$) and the elongation is denoted by L (%), with an assumption that the conductivity is 21% IACS to 31% IACS, the product of Pw, $(100+L)/100$ and $C^{1/2}$ of a material during the recrystallization thermal treatment is 2600 to 3300. The balance among the strength, elongation and electric conduction of a rolled material and the like in a recrystallization thermal treatment process has a large influence on a rolled material after cold finishing rolling, a rolled material after Sn plating and characteristics after the final recovery thermal treatment (after low-temperature annealing). That is, when the product of Pw, $(100+L)/100$ and $C^{1/2}$ is less than 2600, the final rolled material cannot be an alloy having highly balanced characteristics. The product is preferably 2800 or more. On the other hand, when the product of Pw, $(100+L)/100$ and $C^{1/2}$ exceeds 3300, crystal grains are excessively ultra-miniaturized, and, the final rolled material cannot obtain ductility, and cannot be an alloy having highly balanced characteristics (balance index $f2=Pw\times\{(100+L)/100\}\times C^{1/2}$).

In addition, in a rolled material after cold finishing rolling or a rolled material that has been subjected to a recovery thermal treatment after cold finishing rolling, in a W bend test, cracking does not occur at least at R/t=1 (R represents the curvature radius at a bent portion, and t represents the thickness of the rolled material), cracking preferably does not occur at R/t=0.5, and cracking most preferably does not occur at R/t=0. When the stress relaxation rate is represented by Sr %, with an assumption that the tensile strength is 580 $N/mm^2$ or more, the conductivity is 21% IACS to 31% IACS or 32% IACS, the balance index $f2=Pw\times\{(100+L)/100\}\times C^{1/2}$ is 3200 or more, preferably, 3300 to 3800, and the stress relaxation balance index f3 ($f3=Pw\times\{(100+L)/100\}\times C^{1/2}\times(100-Sr)^{1/2}$) is 28500 to 35000. In a rolled material after a recovery thermal treatment, in order to have superior balance, the stress relaxation balance index f3 is 28500 or more, more preferably 29000 or more, and optimally 30000 or more. There is no case in which the stress relaxation balance index f3 exceeds the upper limit value of 35000 unless the rolled material is subjected to a special process. Also, since there are many cases in which proof stress is considered to be more important to tensile strength when using the rolled material, proof stress Pw' is used instead of the tensile strength Pw, and the product of the proof stress Pw', $(100+L)/100$, $C^{1/2}$ and $(100-Sr)^{1/2}$ is 27000 or more, and more preferably 28000 or more. Meanwhile, as assumption conditions, the tensile strength needs to be 580 N/mm$^2$ or more, is preferably 600 N/mm$^2$ or more, and optimally 630 N/mm$^2$ or more. When the proof stress is used instead of the tensile strength, the proof stress needs to be at least 550 N/mm$^2$ or more, preferably 570 N/mm$^2$ or more, and optimally 600 N/mm$^2$ or more. Meanwhile, the maximum tensile strength of the invention alloy in which cracking does not occur at R/t=1 when bending the invention alloy in a W shape is also dependent on the conductivity, but is approximately 750 N/mm$^2$ or less, and the proof stress is 700 N/mm$^2$ or less. Meanwhile, the conductivity is also optimally 22% IACS or more, and the upper limit is 32% IACS or less or 31% IACS or less.

Here, the criterion of the W bend test refers to a fact that, when the test is carried out using test specimens sampled in parallel and vertically to the rolling direction, cracking does not occur in both test specimens.

Furthermore, while the tensile strength and the proof stress can be increased through work hardening with no significant elongation impairment, that is, no cracking at R/t of 1 or less at least when bending into a W shape by adding a working rate of 20% to 50% in a cold finishing rolling process, when the metallic structure is observed, a shape in which crystal grains are elongated in the rolling direction and are compressed in the thickness direction is exhibited, and differences in tensile strength, proof stress and bending workability are caused in the test specimen sampled in the rolling direction and the test specimen sampled in the vertical direction. Regarding the specific metallic structure, crystal grains are elongated crystal grains in a cross-section in parallel to a rolled surface, and are compressed crystal grains in the thickness direction in a horizontal cross-section, and a rolled material sampled vertically to the rolling direction has higher tensile strength and higher proof stress than a rolled material sampled in the parallel direction, and the ratio exceeds 1.05, and, sometimes, reaches 1.08. As the ratio becomes larger than 1, the bending workability of the test specimen sampled vertically to the rolling direction deteriorates. There are also rare cases in which the proof stress becomes, conversely, less than 1.0. A variety of members such as connectors that are the targets of the application are frequently used in the rolling direction and the vertical direction, that is, in both directions of a parallel direction and a vertical direction to the rolling direction when a rolled material is worked into a product for actual use, and it is desirable to make the differences in characteristics in the rolling direction and in the vertical direction on an actually-used surface and a product-worked surface to be nothing or the minimum. In the present invention product, the interaction among Zn, Sn and Ni, that is, a relational formula $20 \leq f1 \leq 32$ is satisfied, crystal grains are set to 1.2 μm to 5.0 μm, the sizes of precipitates formed of P and Co or Ni and the proportions among the elements are controlled to be in predetermined ranges represented by relational formulae E1, E2 and E3 or a relational formula $[Ni]/[P] \geq 10$, and a rolled material is produced using a manufacturing process described below, thereby removing the differences in tensile strength and proof stress between a rolled material sampled in a direction forming 0 degrees with the rolling direction and a rolled material sampled in a direction forming 90 degrees with the rolling direction. Meanwhile, crystal grains are preferably fine from the viewpoint of the roughness of a bending-worked surface and the generation of wrinkles; however, when crystal grains are too fine, the proportion of crystal grain boundaries increases, conversely, the bending workability deteriorates, and the tensile strength and the proof stress become likely to be anisotropic. Therefore, the crystal grain diameter is preferably 4.0 μm or less, and more preferably 3.5 μm or less in a case in which the tensile strength matters. The lower limit is preferably 1.5 μm or more, more preferably 1.8 μm or more, and still more preferably 2.4 μm or more in a case in which the stress relaxation characteristics matter. When the ratios of the tensile strength and the proof stress in a direction forming 0 degrees with respect to the rolling direction to the tensile strength and the proof stress in a direction forming 90 degrees with respect to the rolling direction are 0.95 to 1.05, furthermore, there is a relational formula of $20 \leq f1 \leq 32$, and the average crystal grain diameter is set in a preferable state, the value of 0.99 to 1.04, at which the tensile strength and the proof stress are less anisotropic, can be achieved. Regarding the bending workability as well, as is clear from the metallic structure, when a test specimen is sampled in a direction forming 90 degrees with respect to the rolling direction and subjected to a bend test, the bending workability deteriorates compared with a test specimen sampled in a direction forming 0 degrees; however, in the invention alloys, the tensile strength and the proof stress are isotropic, and almost the same excellent bending workability is obtained in a direction forming 90 degrees and in the direction forming 0 degrees.

The initial temperature of hot rolling is set to 800° C. or higher, and is preferably set to 820° C. or higher in order to form the solid solutions of the respective elements. The initial temperature is set to 920° C. or lower, and preferably set to 910° C. or lower from the viewpoint of energy cost and hot rolling ductility. In addition, in order to form more solid solutions of P, Co and Ni, a rolled material is preferably cooled at a cooling rate of 1° C./second or more in a temperature range of the temperature of the rolled material when final rolling ends to 350° C. or 650° C. to 350° C. so as to at least prevent the precipitates from becoming large precipitates that impair elongation. When a rolled material is cooled at a cooling rate of 1° C./second or less, the precipitates of P, Ni and, furthermore, Co which are in a solid solution form begin to precipitate, and the precipitates become coarsened during cooling. When the precipitates become coarsened in a hot rolling stage, it is difficult to remove the precipitates in the coming thermal treatments such as the annealing process, and the elongation of the final rolled product is impaired.

In addition, a recrystallization thermal treatment process in which the cold workability before the recrystallization thermal treatment process is 55% or more, the peak temperature is 540° C. to 780° C., the holding time in a range of "the peak temperature−50° C." to the peak temperature is 0.04 minutes to 2 minutes, and the thermal treatment index It is $450 \leq It \leq 580$ is carried out.

In order to obtain target fine recrystallized grains in the recrystallization thermal treatment process, since only a decrease in the stacking-fault energy is not sufficient, it is necessary to accumulate strain by cold rolling, specifically, to accumulate strain in crystal grain boundaries in order to increase the number of generation sites of recrystallization nuclei. In order to accumulate strain, the cold working rate in cold rolling before the recrystallization thermal treatment process needs to be 55% or more, is preferably 60% or more, and optimally 65% or more. On the other hand, when the cold working rate in cold rolling before the recrystallization thermal treatment process is excessively increased, since problems of strain and the like caused by the shape of the rolled material occur, the cold working rate is desirably 95% or less, and optimally 93% or less. That is, in order to increase the number of generation sites of recrystallization nuclei using physical actions, it is effective to increase the cold working rate, and finer recrystallized grains can be obtained by adding a high working rate within a range in which strain of a product is permitted.

In addition, in order to obtain fine and uniform sizes of ultimately-targeted crystal grains, it is necessary to specify a relationship between the crystal grain diameter after the annealing process that is a thermal treatment one step before the recrystallization thermal treatment process and the working rate of the second cold rolling before the recrystallization thermal treatment process. That is, when the crystal grain diameter after the recrystallization thermal treatment process is denoted by D1, the crystal grain diameter before the recrystallization thermal treatment process and after the annealing process is denoted by D0, and the cold working rate of cold rolling between the annealing process and the recrystallization thermal treatment process is denoted by RE (%), $D0 \leq D1 \times 4 \times (RE/100)$ is satisfied at RE of 55 to 95. Meanwhile, the numeric formula can be applied with RE in a range of 40 to 95. In order to realize the miniaturization of crystal grains and to make recrystallized grains after the recrystallization thermal treatment process fine and more uniform, the crystal grain diameter after the annealing process is preferably within the product of four times the crystal grain diameter after the recrystallization thermal treatment process and RE/100. Since the number of nucleation sites of recrystallized nuclei increases as the cold working rate increases, fine and more uniform recrystallized grains can be obtained even when the crystal grain diameter after the annealing process has a size three times or more the crystal grain diameter after the recrystallization thermal treatment process.

When the crystal grain diameter after the annealing process is large, the metallic structure after the recrystallization thermal treatment process turns into a mixed-grain state in which large crystal grains and small crystal grains are mixed, and the characteristics after the cold finishing rolling process deteriorate; however, when the cold working rate of cold rolling between the annealing process and the recrystallization thermal treatment process is increased, the characteristics after the cold finishing rolling process do not deteriorate even when crystal grains after the annealing process are somewhat large.

In addition, in the recrystallization thermal treatment process, a short-time thermal treatment is preferable, the peak temperature is 540° C. to 780° C., the holding time in a range of "the peak temperature−50° C." to the peak temperature is 0.04 minutes to 2 minutes, more preferably, the peak temperature is 560° C. to 780° C., the holding time in a range of "the peak temperature−50° C." to the peak temperature is 0.05 minutes to 1.5 minutes, and the thermal treatment index It needs to satisfy a relationship of $450 \leq It \leq 580$. In the relational formula of $450 \leq It \leq 580$, the lower limit side is preferably 465 or more, and more preferably 475 or more, and the upper limit side is preferably 570 or less, and more preferably 560 or less.

Regarding the precipitates of P, Ni, and, furthermore, Co or Fe that suppress the growth of recrystallized grains, round or oval precipitates need to be present in the stage of the recrystallization thermal treatment process, the average grain diameter of the precipitates needs to be 4.0 nm to 25.0 nm or the proportion of precipitates having a grain diameter of 4.0 nm to 25.0 nm in the precipitates needs to be 70% or more. The average grain diameter is preferably 5.0 nm to 20.0 nm or the proportion of precipitates having a grain diameter of 4.0 nm to 25.0 nm in the precipitates is preferably 80% or more. When the average grain diameter of the precipitates decreases, the strength of the rolled material slightly increases due to precipitation strengthening, but the bending workability deteriorates. In addition, when the sizes of the precipitates exceed 50 nm, and, for example, reach 100 nm, the effect that suppresses the growth of crystal grains also almost disappears, and the bending workability deteriorates. Further, the round or oval precipitates include not only perfectly round or oval precipitates but also approximately round or oval precipitates.

When the peak temperature, the holding time or the thermal treatment index It remains below the lower limit of the range that is the condition of the recrystallization thermal treatment process, non-recrystallized portions remain, or ultrafine recrystallized grains having an average crystal grain diameter of less than 1.2 μm are formed. In addition, when annealing is carried out with the peak temperature, the holding time or the thermal treatment index It above the upper limit of the range that is the condition of the recrystallization thermal treatment process, the precipitates are coarsened, form solid solutions again, the predetermined effect that suppresses the growth of crystal grains does not work, and a fine crystal structure having an average grain diameter of 5 μm or less cannot be obtained. In addition, the conduction deteriorates due to the formation of the solid solutions of the precipitates.

The conditions of the recrystallization thermal treatment process are to prevent the excessive re-formation of solid solutions or the coarsening of the precipitates, and, when an appropriate thermal treatment within the numeric formulae is carried out, the effect that suppresses the growth of recrystallized grains is obtained, an appropriate amount of the solid solutions of P, Co and Ni are formed again, and, instead, the elongation of the rolled material is improved. That is, when the temperature of the rolled material begins to exceed 500° C., the precipitates of P, Ni and, furthermore, Co begin to form solid solutions of the precipitates again, and, mainly, small precipitates having a grain diameter of 4 nm or less which have an adverse influence on bending workability disappear. As the temperature and time of the thermal treatment increase, the proportion of precipitates that form solid solutions increases. Since the precipitates are mainly used for the effect that suppresses recrystallized grains, when a lot of fine precipitates with a grain diameter of 4 nm or less or a lot of coarse precipitates having a grain diameter of 25 nm or more remain as the precipitates, the bending workability or elongation of the rolled material is impaired. Meanwhile, when cooling the rolled material in the recrystallization thermal treatment process, the rolled material is preferably cooled under a condition of 1° C./second or more in a temperature range of "the peak temperature−50° C." to 350° C. When the cooling rate is slow, the precipitates grow, and the elongation of the rolled material is impaired. Meanwhile, it is needless to say that batch-type annealing under conditions of, for example, heating from 400° C. to 540° C. and holding for 1 hour to 10 hours may be carried out as the recrystallization thermal treatment process with an assumption that all the requirements of the average crystal grain diameter, the grain diameters of the precipitates and f2 are satisfied.

Furthermore, a recovery thermal treatment process in which the peak temperature is 160° C. to 650° C., the holding time in a range of "the peak temperature−50° C." to the peak temperature is 0.02 minutes to 200 minutes, and the thermal treatment index It satisfies a relationship of $100 \leq It \leq 360$ is preferably carried out after cold finishing rolling.

The recovery thermal treatment process is a thermal treatment for improving the stress relaxation rate, the spring bending elastic limit and the elongation limit of the rolled material or recovering the conductivity decreased by cold finishing rolling through a recovery thermal treatment at a low temperature or for a short time without causing recrystallization. Meanwhile, regarding the thermal treatment index It, the lower limit side is preferably 125 or more, and more preferably 170 or more, and the upper limit side is preferably 345 or less, and more preferably 330 or less. When the recovery thermal treatment process is carried out, the stress relaxation rate improves by approximately ½, the spring bending elastic limit improves by 1.5 times to 2 times, and the conductivity improves by approximately 1% IACS compared with before the thermal treatment. Meanwhile, the invention alloys are mainly used in components of connectors and the like, and there are many cases in which Sn plating is carried out on the ingot in a rolled material state or after forming the invention alloy into a component. In a Sn plating process, the rolled material and the components are heated to approximately 180° C. to 300° C. which is a low temperature. The Sn plating process has little influence on various characteristics of the invention alloy after the recovery thermal treatment even when the Sn plating process is carried out after the recovery thermal treatment. On the other hand, a heating process during Sn plating can replace the recovery thermal treatment process, and improves the stress relaxation characteristics, spring strength and bending workability of the rolled material even when the recovery thermal treatment is not carried out.

As an embodiment of the invention, the manufacturing process sequentially including the hot rolling process, the first cold rolling process, the annealing process, the second cold rolling process, the recrystallization thermal treatment process and the cold finishing rolling process has been exemplified, but the processes up to the recrystallization thermal treatment process may not be carried out. In the metallic structure of the copper alloy material before the cold finishing rolling process, the average crystal grain diameter may be 1.2 μm to 5.0 μm, round or oval precipitates may be present, the average grain diameter of the precipitates may be 4.0 nm to 25.0 nm, or the proportion of precipitates having a grain diameter of 4.0 nm to 25.0 nm in the precipitates may be 70% or more, and, for example, a copper alloy material having such a metallic structure may be obtained through processes such as hot extrusion, forging or a thermal treatment.

Examples

Test specimens were produced using the first invention alloy, the second invention alloy, the third invention alloy, the fourth invention alloy and a copper alloy having a composition for comparison, and various manufacturing processes.

Table 1 describes the compositions of the first invention alloy, the second invention alloy, the third invention alloy, the fourth invention alloy and the copper alloy for comparison which were produced as the test specimens. Here, in a case in which the content of Co is 0.005 mass % or less, the cell for Co is left blank.

TABLE 1

| | Alloy | Alloy composition (mass %) | | | | | | | | | | | | |
|---|---|---|---|---|---|---|---|---|---|---|---|---|---|---|
| | No. | Cu | Zn | Sn | P | Ni | Co | Fe | Others | e1 | e2 | f1 | [Co]/[P] | [Ni]/[P] |
| First | 1 | Rem. | 9.1 | 1.99 | 0.04 | 0.96 | | | | 0.73 | 0.87 | 28.0 | 0.0 | 24.0 |
| invention | 2 | Rem. | 7.5 | 1.28 | 0.06 | 0.91 | | | | 0.47 | 0.56 | 21.5 | 0.0 | 15.2 |
| alloy | 3 | Rem. | 6.5 | 2.14 | 0.06 | 1.24 | | | | 0.64 | 0.76 | 28.0 | 0.0 | 20.7 |
| | 4 | Rem. | 11.4 | 1.7 | 0.05 | 0.92 | | | | 0.77 | 0.92 | 28.2 | 0.0 | 18.4 |
| Second | 5 | Rem. | 8.9 | 1.97 | 0.05 | 0.99 | 0.04 | | | 0.71 | 0.86 | 28.4 | 0.8 | 19.8 |
| invention | 6 | Rem. | 6.4 | 1.58 | 0.04 | 1.22 | 0.03 | | | 0.49 | 0.59 | 23.9 | 0.8 | 30.5 |
| alloy | 7 | Rem. | 7.7 | 2.26 | 0.06 | 1.1 | 0.03 | | | 0.73 | 0.87 | 29.7 | 0.5 | 18.3 |
| | 8 | Rem. | 10.6 | 1.9 | 0.05 | 0.92 | 0.04 | | | 0.78 | 0.94 | 29.3 | 0.8 | 18.4 |
| | 9 | Rem. | 7.8 | 1.94 | 0.05 | 1.13 | 0.01 | | | 0.65 | 0.78 | 27.3 | 0.2 | 22.6 |
| First | 11 | Rem. | 6.2 | 1.75 | 0.04 | 0.73 | | | | 0.52 | 0.63 | 22.3 | 0.0 | 18.3 |
| invention | 12 | Rem. | 10.8 | 2.1 | 0.06 | 0.95 | | | | 0.84 | 1.01 | 30.7 | 0.0 | 15.8 |
| alloy | 13 | Rem. | 8.2 | 1.94 | 0.05 | 1.35 | | | | 0.67 | 0.80 | 28.6 | 0.0 | 27.0 |
| Second | 14 | Rem. | 6.4 | 1.7 | 0.04 | 1.4 | 0.02 | | | 0.52 | 0.62 | 25.4 | 0.5 | 35.0 |
| invention | 15 | Rem. | 10.6 | 2.12 | 0.05 | 0.88 | 0.05 | | | 0.84 | 1.00 | 30.8 | 1.0 | 17.6 |
| alloy | 16 | Rem. | 8.6 | 2.37 | 0.06 | 0.7 | 0.05 | | | 0.80 | 0.96 | 29.8 | 0.8 | 11.7 |
| Third | 171 | Rem. | 8.8 | 1.97 | 0.05 | 1 | | 0.02 | | 0.71 | 0.85 | 27.8 | 0.0 | 20.0 |
| invention alloy | 172 | Rem. | 6.4 | 1.77 | 0.05 | 0.76 | | 0.015 | | 0.54 | 0.65 | 23.0 | 0.0 | 15.2 |
| Fourth invention alloy | 173 | Rem. | 7.6 | 2.16 | 0.05 | 1.11 | 0.03 | 0.008 | | 0.70 | 0.83 | 28.8 | 0.6 | 22.2 |
| First invention alloy | 174 | Rem. | 6.7 | 1.42 | 0.04 | 0.72 | | | | 0.47 | 0.56 | 20.5 | 0.0 | 18.0 |
| Second invention alloy | 175 | Rem. | 5.7 | 1.76 | 0.04 | 0.83 | 0.01 | | | 0.50 | 0.60 | 22.5 | 0.3 | 20.8 |
| Alloy for | 21 | Rem. | 9.1 | 2 | 0.06 | 0.51 | | | | 0.73 | 0.88 | 26.3 | 0.0 | 8.5 |
| comparison | 22 | Rem. | 9.4 | 1.82 | 0.004 | 1.1 | | | | 0.70 | 0.84 | 27.2 | 0.0 | 275.0 |
| | 23 | Rem. | 8.8 | 1.92 | 0.13 | 0.88 | | | | 0.70 | 0.83 | 28.2 | 0.0 | 6.8 |
| | 24 | Rem. | 9 | 1.92 | 0.06 | 0.93 | 0.12 | | | 0.71 | 0.85 | 29.0 | 2.0 | 15.5 |
| | 25 | Rem. | 8.5 | 1.85 | 0.14 | 0.87 | 0.05 | | | 0.66 | 0.80 | 28.1 | 0.4 | 6.2 |
| | 26 | Rem. | 8.4 | 2.08 | 0.07 | 0.52 | 0.03 | | | 0.72 | 0.86 | 26.7 | 0.4 | 7.4 |
| | 27 | Rem. | 4.2 | 1.8 | 0.05 | 1.17 | | | | 0.44 | 0.52 | 22.8 | 0.0 | 23.4 |
| | 28 | Rem. | 4.4 | 1.82 | 0.05 | 1.09 | 0.03 | | | 0.45 | 0.54 | 23.2 | 0.6 | 21.8 |
| | 29 | Rem. | 12.5 | 1.74 | 0.03 | 0.84 | 0.04 | | | 0.84 | 1.00 | 29.4 | 1.3 | 28.0 |
| | 30 | Rem. | 6.3 | 0.99 | 0.06 | 1.4 | | | | 0.34 | 0.41 | 20.4 | 0.0 | 23.3 |
| | 31 | Rem. | 8.5 | 2.6 | 0.05 | 0.78 | | | | 0.85 | 1.02 | 31.0 | 0.0 | 15.6 |
| | 33 | Rem. | 6.1 | 1.3 | 0.04 | 0.67 | | | | 0.41 | 0.49 | 18.8 | 0.0 | 16.8 |
| | 35 | Rem. | 9.6 | 2.28 | 0.05 | 1.33 | | | | 0.83 | 0.99 | 32.3 | 0.0 | 26.6 |
| | 36 | Rem. | 10.8 | 1.99 | 0.06 | 1.38 | 0.04 | | | 0.81 | 0.98 | 32.3 | 0.7 | 23.0 |
| | 37 | Rem. | 9.6 | 1.9 | 0.05 | 0.92 | 0.01 | | Cr: 0.04 | 0.73 | 0.88 | 27.9 | 0.2 | 18.4 |

TABLE 1-continued

| Alloy | Alloy composition (mass %) | | | | | | | | | | | | |
|---|---|---|---|---|---|---|---|---|---|---|---|---|---|
| No. | Cu | Zn | Sn | P | Ni | Co | Fe | Others | e1 | e2 | f1 | [Co]/[P] | [Ni]/[P] |
| 38 | Rem. | 9.2 | 2.05 | 0.06 | 0.88 | | 0.05 | | 0.75 | 0.90 | 28.4 | 0.0 | 14.7 |
| 39 | Rem. | 8.8 | 1.98 | 0.05 | 0.75 | 0.03 | 0.03 | | 0.71 | 0.85 | 27.1 | 0.6 | 15.0 |
| 42 | Rem. | 7.9 | 1.12 | 0.04 | 0.61 | 0.02 | | | 0.45 | 0.54 | 19.3 | 0.5 | 15.3 |

e1 = 0.05([Zn] − 3) + 0.25([Sn] − 0.3)
e2 = 0.06([Zn] − 3) + 0.3([Sn] − 0.3),
f1 = [Zn] + 7[Sn] + 15[P] + 12[Co] + 4.5[Ni]

Alloy No. 21 has less Ni than the composition range of the invention alloy.

Alloy No. 22 has less P than the composition range of the invention alloy.

Alloy No. 23 has more P than the composition range of the invention alloy.

Alloy No. 24 has more Co than the composition range of the invention alloy.

Alloy No. 25 has more P than the composition range of the invention alloy.

Alloy No. 26 has less Ni than the composition range of the invention alloy.

Alloy No. 27 has less Zn than the composition range of the invention alloy.

Alloy No. 28 has less Zn than the composition range of the invention alloy.

Alloy No. 29 has more Zn than the composition range of the invention alloy.

Alloy No. 30 has less Sn than the composition range of the invention alloy.

Alloy No. 31 has more Sn than the composition range of the invention alloy.

Alloy No. 33 has a smaller composition index f1 than the range of the invention alloy.

Alloys No. 35 and 36 have a larger composition index f1 than the range of the invention alloy.

Alloy No. 37 contains Cr.

Alloy No. 38 has more Fe than the composition range of the invention alloy.

Alloy No. 42 has a smaller composition index f1 than the range of the invention alloy.

Three types of manufacturing processes A, B and C of the test specimens were carried out, and the manufacturing conditions were further changed in the respective manufacturing processes. Manufacturing Process A was carried out in an actual mass production facility, and the manufacturing processes B and C were carried out in an experimental facility. Table 2 describes the manufacturing conditions of the respective manufacturing processes.

In addition, FIG. 1 illustrates transmission electronic microscopic photographs of a copper alloy sheet of Test No. N1 (Alloy No. 9, Process A1). The average grain diameter of precipitates is approximately 7.4 nm, and uniformly distributed.

TABLE 2

| Process No. | | Hot rolling process Initial temperature, sheet thickness | Cooling process Cooling rate | Milling process Sheet thickness | First cold rolling process Sheet thickness | First cold rolling process Red *1 | Annealing process Thermal treatment conditions | Second cold rolling process Sheet thickness |
|---|---|---|---|---|---|---|---|---|
| A1 | Example | 860° C., 13 mm | 3° C./second | 12 mm | 1.5 mm | 87.5% | 460° C. × 4 Hr | 0.45 mm |
| A2 | Example | 860° C., 13 mm | 3° C./second | 12 mm | 1.5 mm | 87.5% | 460° C. × 4 Hr | 0.45 mm |
| A3 | Example | 860° C., 13 mm | 3° C./second | 12 mm | 1.5 mm | 87.5% | 460° C. × 4 Hr | 0.45 mm |
| A4 | Comparative Example | 860° C., 13 mm | 3° C./second | 12 mm | 1.5 mm | 87.5% | 460° C. × 4 Hr | 0.45 mm |
| A41 | Comparative Example | 860° C., 13 mm | 3° C./second | 12 mm | 1.5 mm | 87.5% | 460° C. × 4 Hr | 0.435 mm |
| A5 | Comparative Example | 860° C., 13 mm | 3° C./second | 12 mm | 1.5 mm | 87.5% | 460° C. × 4 Hr | 0.45 mm |
| A6 | Example | 860° C., 13 mm | 3° C./second | 12 mm | 1.5 mm | 87.5% | 460° C. × 4 Hr | 0.45 mm |
| B1 | Example | 860° C., 8 mm | 3° C./second | Pickled | 1.5 mm | 81.3% | 610° C. × 0.23 min | 0.45 mm |
| B21 | Comparative Example | 860° C., 8 mm | 0.3° C./second | Pickled | 1.5 mm | 81.3% | 610° C. × 0.23 min | 0.45 mm |
| B32 | Comparative Example | 860° C., 8 mm | 3° C./second | Pickled | 0.75 mm | 90.6% | 460° C. × 4 Hr | 0.45 mm |
| B42 | Comparative Example | 860° C., 8 mm | 3° C./second | Pickled | 1.5 mm | 81.3% | 570° C. × 4 Hr | 0.45 mm |
| C1 | Example | 860° C., 8 mm | 3° C./second | Pickled | 1.5 mm | 81.3% | 610° C. × 0.23 min | 0.45 mm |

TABLE 2-continued

| Process No. | Second cold rolling process Red | Recrystallization thermal treatment process: Thermal treatment conditions | Recrystallization thermal treatment process: It | Cold finishing rolling process: Sheet thickness | Cold finishing rolling process: Red | Recovery thermal treatment process: Thermal treatment conditions | Recovery thermal treatment process: It |
|---|---|---|---|---|---|---|---|
| A1 | 70% | 680° C. × 0.09 min | 519 | 0.3 mm | 33.3% | 540° C. × 0.04 min | 299 |
| A2 | 70% | 650° C. × 0.09 min | 481 | 0.3 mm | 33.3% | 540° C. × 0.04 min | 299 |
| A3 | 70% | 715° C. × 0.09 min | 554 | 0.3 mm | 33.3% | 540° C. × 0.04 min | 299 |
| A4 | 70% | 625° C. × 0.07 min | 446 | 0.3 mm | 33.3% | 540° C. × 0.04 min | 299 |
| A41 | 71% | 625° C. × 0.07 min | 447 | 0.3 mm | 37.5% | 540° C. × 0.04 min | 300 |
| A5 | 70% | 770° C. × 0.07 min | 591 | 0.3 mm | 33.3% | 540° C. × 0.04 min | 299 |
| A6 | 70% | 680° C. × 0.09 min | 519 | 0.3 mm | 33.3% | | |
| B1 | 70% | 680° C. × 0.09 min | 519 | 0.3 mm | 33.3% | 540° C. × 0.04 min | 299 |
| B21 | 70% | 680° C. × 0.09 min | 519 | 0.3 mm | 33.3% | 540° C. × 0.04 min | 299 |
| B32 | 40% | 680° C. × 0.09 min | 508 | 0.3 mm | 33.3% | 540° C. × 0.04 min | 299 |
| B42 | 70% | 680° C. × 0.09 min | 519 | 0.3 mm | 33.3% | 540° C. × 0.04 min | 299 |
| C1 | 70% | 680° C. × 0.09 min | 519 | 0.3 mm | 33.3% | 540° C. × 0.04 min | 299 |

*1 Red in the first cold rolling process was computed with an assumption that there was no reduction of the sheet thickness due to pickling.

In Manufacturing Process A (A1, A2, A3, A4, A41, A5 and A6), raw materials were melted in a mid-frequency melting furnace with an inside volume of 10 tons, and ingots having a cross-section with a thickness of 190 mm and a width of 630 mm were manufactured through semi-continuous casting. The ingots were respectively cut into a length of 1.5 m, and then a hot rolling process (sheet thickness 13 mm)-a cooling process-milling process (sheet thickness 12 mm)-a first cold rolling process (sheet thickness 1.5 mm)-an annealing process (held at 460° C. for hours)-a second cold rolling process (sheet thickness 0.45 mm, cold working rate 70%; sheet thickness 0.435 mm, cold working rate 71% for some part)-a recrystallization thermal treatment process-a cold finishing rolling process (sheet thickness 0.3 mm, cold working rate 33.3%; cold working rate 31.0% for some parts)-a recovery thermal treatment process were carried out.

The hot rolling initial temperature in the hot rolling process was set to 860° C., the ingots were hot-rolled to a sheet thickness of 13 mm, and then showered using water for cooling in the cooling process. In the specification, the hot rolling initial temperature and the ingot heating temperature have the same meaning. The average cooling rate in the cooling process refers to a cooling rate in a temperature range of the temperature of the rolled material after final hot rolling to 350° C. or a temperature of the rolled material of 650° C. to 350° C., and the average cooling rate was measured at the rear end of a rolled sheet. The measured average cooling rate was 3° C./second.

The ingots were showered using water for cooling in the cooling process in the following manner. A shower facility is provided at a place that is above a transporting roller that transports the rolled material during hot rolling and is away from a hot rolling roller. When the final path of hot rolling ends, the rolled material is sent to the shower facility using the transportation roller, and sequentially cooled from the front end to the rear end while being made to pass a place in which showering is carried out. In addition, the cooling rate was measured in the following manner. The temperature of the rolled material was measured at the rear end portion (accurately, a location that is 90% of the length of the rolled material from the rolling front end in the longitudinal direction of the rolled material) of the rolled material in the final pass of hot rolling, the temperature was measured immediately before sending the rolled material to the shower facility after the end of the final pass, and at a point in time when the showering ended, and the cooling rate was computed based on the temperature measured at these times and time intervals at which the temperatures were measured. The temperature was measured using a radiation thermometer. As the radiation thermometer, an infrared thermometer Fluke-574 manufactured by Takachihoseiki Co., Ltd. was used. In order to measure the temperature, the rolled material is put into an air cooling state until the rear end of the rolled material reaches the shower facility and shower water is applied to the rolled material, and the cooling rate at this time becomes slow. In addition, as the final sheet thickness decreases, it takes a longer time for the rolled material to reach the shower facility, and therefore the cooling rate becomes slow.

The annealing process includes a heating step of heating the rolled material to a predetermined temperature, a holding step of holding the rolled material after the heating step at a predetermined temperature for a predetermined time, and a cooling step of cooling the rolled material after the holding step to a predetermined temperature. The peak temperature was set to 460° C., and the holding time was set to 4 hours.

In the recrystallization thermal treatment process, the peak temperature Tmax (° C.) of the rolled material and the holding time tm (min) in a temperature range of a temperature 50° C. lower than the peak temperature of the rolled material to the peak temperature were changed to (680° C.-0.09 min), (650° C.-0.08 min), (715° C.-0.09 min), (625° C.-0.07 min) and (770° C.-0.07 min).

In the recovery thermal treatment process, the peak temperature Tmax (° C.) of the rolled material was set to 540 (° C.), and the holding time tm (min) in a temperature range of a temperature 50° C. lower than the peak temperature of the rolled material to the peak temperature was set to 0.04 minutes. However, in Manufacturing Process A6, the recovery thermal treatment process was not carried out.

In addition, Manufacturing Process B (B1, B21, B31, B32, B41 and B42) were carried out in the following manner.

An ingot for laboratory tests having a thickness of 40 mm, a width of 120 mm and a length of 190 mm was cut out from the ingot in Manufacturing Process A, and then a hot rolling process (sheet thickness 8 mm)-a cooling process (cooling through shower using water)-a pickling process-a first cold rolling process-an annealing process-a second cold rolling process (sheet thickness 0.45 mm)-a recrystallization thermal treatment process-a cold finishing rolling process (sheet thickness 0.3 mm, working rate 33.3%)-a recovery thermal treatment process were carried out.

In the hot rolling process, the ingot was heated to 860° C., and hot-rolled to a thickness of 8 mm. The cooling rate (a cooling rate from the temperature of the rolled material after hot rolling to 350° C. or a temperature of the rolled material of 650° C. to 350° C.) in the cooling process was mainly 3° C./second, and was 0.3° C./second for some parts.

After the cooling process, the surface was pickled, the ingot was cold-rolled to 1.5 mm or 0.75 mm in the first cold rolling process, and the conditions for the annealing process were changed to (held at 610° C. for 0.23 minutes) (held at 460° C. for 4 hours) (held at 570° C. for 4 hours). After that, the ingot was rolled to 0.45 mm in the second cold rolling process.

The recrystallization thermal treatment process was carried out under conditions of Tmax of 680° C. and a holding time tm of 0.09 minutes. In addition, the ingot was cold-rolled to 0.3 mm (cold working rate: 33.3%) in the cold finishing rolling process, and the recovery thermal treatment process was carried out under conditions of Tmax of 540° C. and a holding time tm of 0.04 minutes.

In Manufacturing Process B and Manufacturing Process C described below, a process corresponding to the short-time thermal treatment carried out in a continuous annealing line or the like in Manufacturing Process A was replaced by the immersion of the rolled material in a salt bath, the peak temperature was set to the solution temperature in the salt bath, the immersion time was set to a holding time, and the ingot was cooled in the air after being immersed. Meanwhile, as the salt (solution), a mixture of BaCl, KCl and NaCl was used.

Furthermore, Manufacturing Process C (C1) was carried out in the following manner as a laboratory test. The ingot was melted and cast in an electric furnace in a laboratory so as to obtain predetermined components, thereby obtaining an ingot for laboratory test having a thickness of 40 mm, a width of 120 mm and a length of 190 mm. After that, test specimens were manufactured using the same processes as in Manufacturing Process B. That is, an ingot was heated to 860° C., hot-rolled to a thickness of mm, and cooled at a cooling rate of 3° C./second in a temperature range of the temperature of the rolled material after hot rolling to 350° C. or a temperature of the rolled material of 650° C. to 350° C. after hot rolling. After cooling, the surface was pickled, and the ingot was cold-rolled to 1.5 mm in the first cold rolling process. After cold rolling, the annealing process was carried out under conditions of 610° C. and 0.23 minutes after cold rolling, and the ingot was cold-rolled to 0.45 mm in the second cold rolling process. The recrystallization thermal treatment process was carried out under conditions of Tmax of 680° C. and a holding time tm of 0.09 minutes. In addition, the ingot was cold-rolled to 0.3 mm (cold working rate: 33.3%) in the cold finishing rolling process, and the recovery thermal treatment process was carried out under conditions of Tmax of 540° C. and a holding time tm of 0.04 minutes.

To evaluate the copper alloys produced using the above methods, tensile strength, proof stress, elongation, conductivity, bending workability, stress relaxation rate, stress corrosion cracking resistance and the spring bending elastic limit were measured. In addition, the average crystal grain diameters were measured by observing the metallic structures. In addition, the average grain diameters of precipitates and the proportions of precipitates having a grain diameter of a predetermined value or less in precipitates of all sizes were measured.

The results of the respective tests are described in Tables 3 to 12. Here, the test results of the respective test Nos. are described in two tables such as Tables 3 and 4. Further, since the recovery thermal treatment process was not carried out in Manufacturing Process A6, data after the cold finishing rolling process are described in the column for data after the recovery thermal treatment process.

TABLE 3

| | | | | | | | After recovery thermal treatment process | | | | | | | | |
|---|---|---|---|---|---|---|---|---|---|---|---|---|---|---|---|
| | | | Average crystal grain diameter after annealing | After recrystallization thermal treatment process | | | Characteristics of rolled material (0 degree direction) | | | | | | | Characteristics of rolled material (90 degree direction) | |
| | | | | Average crystal grain | Precipitated grains | | | | | | | | | | |
| Test No. | Alloy No. | Process No. | Process D0 μm | diameter D1 μm | Average grain diameter nm | Proportion of grains of 4 nm to 25 nm % | Tensile strength N/mm$^2$ | Proof stress N/mm$^2$ | Elongation % | Conductivity % IACS | Stress relaxation rate % | Balance index f2 | Stress relaxation balance index f3 | Tensile strength N/mm$^2$ | Proof stress N/mm$^2$ |
| 1 | 1 | A1 | 3.2 | 2.5 | 9.2 | 94 | 643 | 622 | 8 | 24.8 | 18 | 3458 | 31316 | 662 | 630 |
| 2 | | A2 | | 2.1 | 9.4 | 93 | 660 | 636 | 7 | 24.9 | 20 | 3524 | 31519 | 683 | 652 |
| 3 | | A4 | | 1.3 | 5.5 | 75 | 682 | 654 | 6 | 25.1 | 24 | 3622 | 31574 | 719 | 684 |
| 4 | | A41 | | 1.3 | 5.5 | 77 | 663 | 634 | 6 | 25.1 | 23 | 3521 | 30896 | 697 | 661 |
| 5 | | A3 | | 3.4 | 13 | 88 | 625 | 602 | 8 | 24.6 | 24 | 3348 | 29186 | 641 | 620 |
| 6 | | A5 | | 8 | 50 | 25 | 592 | 567 | 9 | 24.3 | 18 | 3181 | 28804 | 627 | 601 |
| 8 | | B1 | 3.3 | 2.6 | 9.5 | 94 | 642 | 615 | 8 | 24.9 | 18 | 3460 | 31330 | 657 | 628 |
| 9 | | B21 | | 4.5 | 16 | 70 | 618 | 592 | 6 | 24.7 | 24 | 3256 | 28382 | 652 | 624 |

TABLE 3-continued

| | | | | | | | After recovery thermal treatment process | | | | | | | | |
|---|---|---|---|---|---|---|---|---|---|---|---|---|---|---|---|
| | | | Average crystal grain diameter after annealing | After recrystallization thermal treatment process | | | Characteristics of rolled material (0 degree direction) | | | | | | | Characteristics of rolled material (90 degree direction) | |
| | | | | Average crystal grain | Precipitated grains | | | | | | | | | | |
| Test No. | Alloy No. | Process No. | process D0 μm | diameter D1 μm | Average grain diameter nm | Proportion of grains of 4 nm to 25 nm % | Tensile strength N/mm$^2$ | Proof stress N/mm$^2$ | Elongation % | Conductivity % IACS | Stress relaxation rate % | Balance index f2 | Stress relaxation balance index f3 | Tensile strength N/mm$^2$ | Proof stress N/mm$^2$ |
| 11 | | B32 | 3 | 3.1 | Mixed grain | | 627 | 599 | 6 | 24.9 | 24 | 3316 | 28912 | 658 | 629 |
| 13 | | B42 | 11 | 3.5 | Mixed grain | | 619 | 600 | 5 | 25.1 | 25 | 3256 | 28200 | 657 | 633 |
| 14 | 2 | A1 | | 3.2 | 8.5 | 93 | 605 | 583 | 9 | 29.8 | 14 | 3600 | 33384 | 617 | 595 |
| 15 | | A2 | | 2.5 | 8 | 92 | 617 | 596 | 8 | 29.9 | 15 | 3644 | 33593 | 634 | 610 |
| 16 | | A4 | | 1.6 | 6.5 | 85 | 636 | 610 | 6 | 30.1 | 19 | 3699 | 33288 | 669 | 633 |
| 17 | | A3 | | 3.8 | 9.5 | 94 | 587 | 565 | 9 | 29.8 | 13 | 3493 | 32579 | 606 | 582 |
| 18 | | A5 | | 10 | 45 | 25 | 554 | 530 | 9 | 29.5 | 18 | 3280 | 29700 | 588 | 562 |
| 19 | | A6 | | 3.2 | 8.5 | 93 | 616 | 590 | 5 | 29 | 25 | 3483 | 30165 | 639 | 601 |
| 20 | 3 | A1 | 3.6 | 2.7 | 8.5 | 94 | 632 | 608 | 8 | 25.5 | 15 | 3447 | 31778 | 648 | 620 |
| 21 | | A2 | | 2.2 | 7.5 | 87 | 645 | 621 | 7 | 25.5 | 17 | 3485 | 31751 | 664 | 635 |
| 22 | | A4 | | 1.4 | 4.5 | 65 | 668 | 646 | 6 | 25.7 | 22 | 3590 | 31703 | 703 | 673 |

TABLE 4

| | | | After recovery thermal treatment process | | | | | | | |
|---|---|---|---|---|---|---|---|---|---|---|
| | | | Ratio of tensile strength | Ratio of proof stress | Bending workability | | Stress corrosion cracking resistance | | Spring bending elastic limit | |
| Test No. | Alloy No. | Process No. | (90 degrees/0 degrees) | (90 degrees/0 degrees) | 90 degree direction Bad Way | 0 degree direction Good Way | Stress corrosion 1 | Stress corrosion 2 | 0 degree direction N/mm$^2$ | 90 degree direction N/mm$^2$ |
| 1 | 1 | A1 | 1.03 | 1.01 | A | A | A | A | 600 | 612 |
| 2 | | A2 | 1.03 | 1.03 | A | A | A | A | 615 | 633 |
| 3 | | A4 | 1.05 | 1.05 | C | B | A | A | | |
| 4 | | A41 | 1.05 | 1.04 | B | B | A | A | | |
| 5 | | A3 | 1.03 | 1.03 | A | A | A | A | | |
| 6 | | A5 | 1.06 | 1.06 | A | A | A | A | 527 | 553 |
| 8 | | B1 | 1.02 | 1.02 | A | A | A | A | | |
| 9 | | B21 | 1.06 | 1.05 | B | A | A | A | 456 | 499 |
| 11 | | B32 | 1.05 | 1.05 | B | A | A | A | | |
| 13 | | B42 | 1.06 | 1.06 | B | A | A | A | 496 | 561 |
| 14 | 2 | A1 | 1.02 | 1.02 | A | A | A | A | 558 | 579 |
| 15 | | A2 | 1.03 | 1.02 | A | A | A | A | 583 | 600 |
| 16 | | A4 | 1.05 | 1.04 | B | A | A | A | 604 | 646 |
| 17 | | A3 | 1.03 | 1.03 | A | A | A | A | | |
| 18 | | A5 | 1.06 | 1.06 | A | A | A | A | 510 | 554 |
| 19 | | A6 | 1.04 | 1.02 | A | A | A | A | 403 | 447 |
| 20 | 3 | A1 | 1.03 | 1.02 | A | A | A | A | 574 | 601 |
| 21 | | A2 | 1.03 | 1.02 | A | A | A | A | 593 | 622 |
| 22 | | A4 | 1.05 | 1.04 | C | A | A | A | | |

TABLE 5

| Test No. | Alloy No. | Process No. | Average crystal grain diameter after annealing process D0 μm | After recrystallization thermal treatment process: Average crystal grain diameter D1 μm | Precipitated grains: Average grain diameter nm | Precipitated grains: Proportion of grains of 4 nm to 25 nm % | After recovery thermal treatment process: Characteristics of rolled material (0 degree direction): Tensile strength N/mm$^2$ | Proof stress N/mm$^2$ | Elongation % | Conductivity % IACS | Stress relaxation rate % | Balance index f2 | Stress relaxation balance index f3 | Characteristics of rolled material (90 degree direction): Tensile strength N/mm$^2$ | Proof stress N/mm$^2$ |
|---|---|---|---|---|---|---|---|---|---|---|---|---|---|---|---|
| 23 | 3 | A3 | | 3.6 | 13 | 95 | 617 | 593 | 9 | 25.4 | 14 | 3389 | 31432 | 632 | 605 |
| 24 | | A5 | | 9 | 50 | 20 | 578 | 555 | 9 | 25.1 | 19 | 3156 | 28408 | 612 | 585 |
| 25 | | A6 | | 2.7 | 8.5 | 94 | 647 | 617 | 5 | 25.5 | 24 | 3431 | 29907 | 670 | 625 |
| 26 | | B1 | 3.8 | 2.7 | 8.7 | 95 | 633 | 606 | 8 | 25.5 | 15 | 3452 | 31828 | 650 | 622 |
| 27 | | B21 | | 4.5 | 14 | 72 | 601 | 573 | 7 | 25.7 | 22 | 3260 | 28792 | 632 | 596 |
| 29 | | B32 | 3.5 | 3.5 | Mixed grain | | 615 | 588 | 6 | 25.6 | 21 | 3298 | 29317 | 651 | 620 |
| 31 | | B42 | 12 | 3.6 | Mixed grain | | 613 | 592 | 4 | 25.8 | 22 | 3238 | 28599 | 647 | 622 |
| 32 | 4 | A1 | | 2.8 | 9 | 93 | 641 | 620 | 8 | 24.6 | 20 | 3434 | 30711 | 659 | 633 |
| 33 | | A2 | | 2.2 | 6.5 | 85 | 654 | 633 | 6 | 24.6 | 22 | 3438 | 30367 | 674 | 647 |
| 34 | | A4 | | 1.4 | 4.5 | 60 | 682 | 657 | 5 | 24.7 | 28 | 3559 | 30199 | 719 | 683 |
| 35 | | A5 | | 10 | 50 | 20 | 584 | 553 | 8 | 24.3 | 24 | 3109 | 27105 | 618 | 579 |
| 36 | 5 | A1 | 2.5 | 2.1 | 7 | 88 | 666 | 644 | 7 | 25.1 | 19 | 3570 | 32132 | 685 | 652 |
| 37 | | A2 | | 1.7 | 6 | 82 | 680 | 654 | 6 | 25.1 | 21 | 3611 | 32097 | 706 | 676 |
| 38 | | A4 | | 1.1 | 3.7 | 35 | 706 | 678 | 5 | 25.2 | 28 | 3721 | 31576 | 747 | 714 |
| 39 | | A41 | | 1.1 | 3.7 | 35 | 686 | 654 | 6 | 25.2 | 27 | 3650 | 31188 | 722 | 686 |
| 40 | | A3 | | 2.5 | 9.5 | 92 | 655 | 627 | 8 | 25 | 17 | 3537 | 32224 | 670 | 639 |
| 41 | | A5 | | 6 | 55 | 25 | 603 | 575 | 7 | 24.7 | 23 | 3207 | 28138 | 642 | 609 |
| 42 | | A6 | | 2.1 | 7 | 88 | 680 | 655 | 5 | 24.5 | 33 | 3534 | 28928 | 702 | 666 |
| 43 | | B1 | 2.7 | 2 | 6.8 | 89 | 664 | 645 | 7 | 25.2 | 20 | 3567 | 31900 | 683 | 654 |
| 44 | | B21 | | 4.2 | 12 | 75 | 623 | 594 | 6 | 25.4 | 26 | 3328 | 28630 | 659 | 622 |

TABLE 6

| Test No. | Alloy No. | Process No. | After recovery thermal treatment process: Ratio of tensile strength (90 degrees/0 degrees) | Ratio of proof stress (90 degrees/0 degrees) | Bending workability: 90 degree direction Bad Way | Bending workability: 0 degree direction Good Way | Stress corrosion cracking resistance: Stress corrosion 1 | Stress corrosion 2 | Spring bending elastic limit: 0 degree direction N/mm$^2$ | Spring bending elastic limit: 90 degree direction N/mm$^2$ |
|---|---|---|---|---|---|---|---|---|---|---|
| 23 | 3 | A3 | 1.02 | 1.02 | A | A | A | A | | |
| 24 | | A5 | 1.06 | 1.05 | A | A | A | A | | |
| 25 | | A6 | 1.04 | 1.01 | B | A | A | A | | |
| 26 | | B1 | 1.03 | 1.03 | A | A | A | A | | |
| 27 | | B21 | 1.05 | 1.04 | B | A | A | A | 506 | 557 |
| 29 | | B32 | 1.06 | 1.05 | B | A | A | A | | |
| 31 | | B42 | 1.06 | 1.05 | B | A | A | A | 492 | 555 |
| 32 | 4 | A1 | 1.03 | 1.02 | A | A | A | B | | |
| 33 | | A2 | 1.03 | 1.02 | B | A | A | B | | |
| 34 | | A4 | 1.05 | 1.04 | C | B | A | B | | |
| 35 | | A5 | 1.06 | 1.05 | B | A | B | B | | |
| 36 | 5 | A1 | 1.03 | 1.01 | A | A | A | A | 628 | 644 |
| 37 | | A2 | 1.04 | 1.03 | B | A | A | A | 647 | 665 |
| 38 | | A4 | 1.06 | 1.05 | C | B | A | A | | |
| 39 | | A41 | 1.05 | 1.05 | C | A | A | A | | |
| 40 | | A3 | 1.02 | 1.02 | A | A | A | A | | |
| 41 | | A5 | 1.06 | 1.06 | B | A | A | A | 503 | 572 |
| 42 | | A6 | 1.03 | 1.02 | A | A | A | A | 425 | 460 |
| 43 | | B1 | 1.03 | 1.01 | A | A | A | A | | |
| 44 | | B21 | 1.06 | 1.05 | B | A | A | A | 498 | 585 |

TABLE 7

| Test No. | Alloy No. | Process No. | Average crystal grain diameter after annealing process D0 μm | After recrystallization thermal treatment process: Average crystal grain diameter D1 μm | Precipitated grains: Average grain diameter nm | Precipitated grains: Proportion of grains of 4 nm to 25 nm % | After recovery thermal treatment process: Characteristics of rolled material (0 degree direction): Tensile strength N/mm$^2$ | Proof stress N/mm$^2$ | Elongation % |
|---|---|---|---|---|---|---|---|---|---|
| 46 | 5 | B32 | 2.5 | 3 | Mixed grain | | 645 | 616 | 5 |
| 48 | | B42 | 12 | 3.5 | Mixed grain | | 634 | 603 | 4 |
| 49 | 6 | A1 | 3.5 | 2.5 | 7.5 | 92 | 629 | 606 | 8 |
| 50 | | A2 | | 2.2 | 6.6 | 90 | 640 | 615 | 7 |
| 51 | | A3 | | 3.1 | 12 | 92 | 613 | 587 | 9 |
| 52 | | A5 | | 10 | 55 | 15 | 573 | 541 | 7 |
| 53 | | A6 | | 2.5 | 7.5 | 92 | 644 | 617 | 4 |
| 54 | | B1 | 3.8 | 2.5 | 7 | 91 | 627 | 604 | 8 |
| 55 | | B21 | | 4.3 | 18 | 60 | 592 | 562 | 7 |
| 57 | | B32 | 3.8 | 3.3 | Mixed grain | | 598 | 564 | 6 |
| 59 | | B42 | 13.5 | 3.5 | Mixed grain | | 593 | 560 | 5 |
| 60 | 7 | A1 | | 2.1 | 7.5 | 94 | 668 | 644 | 7 |
| 61 | | A2 | | 1.8 | 5.7 | 75 | 681 | 655 | 6 |
| 62 | | A5 | | 7 | 30 | 15 | 601 | 573 | 7 |
| 63 | 8 | A1 | | 2 | 6.5 | 88 | 673 | 650 | 7 |
| 64 | | A2 | | 1.7 | 6 | 76 | 687 | 662 | 6 |
| 65 | | A4 | | 1.1 | 3.8 | 40 | 714 | 686 | 5 |
| 66 | | A41 | | 1.1 | 3.6 | 40 | 689 | 661 | 5 |

| Test No. | After recovery thermal treatment process: Conductivity % IACS | Stress relaxation rate % | Balance index f2 | Stress relaxation balance index f3 | Characteristics of rolled material (90 degree direction): Tensile strength N/mm$^2$ | Proof stress N/mm$^2$ |
|---|---|---|---|---|---|---|
| 46 | 25 | 25 | 3386 | 29326 | 681 | 646 |
| 48 | 25.5 | 24 | 3330 | 29027 | 670 | 635 |
| 49 | 27.7 | 14 | 3575 | 33156 | 644 | 613 |
| 50 | 27.8 | 16 | 3611 | 33092 | 656 | 624 |
| 51 | 27.5 | 13 | 3504 | 32682 | 628 | 601 |
| 52 | 27 | 19 | 3186 | 28672 | 606 | 572 |
| 53 | 26.8 | 14 | 3467 | 32154 | 665 | 628 |
| 54 | 27.7 | 14 | 3564 | 33051 | 643 | 610 |
| 55 | 28 | 23 | 3352 | 29412 | 630 | 599 |
| 57 | 27.6 | 20 | 3330 | 29786 | 631 | 598 |
| 59 | 28 | 21 | 3295 | 29284 | 631 | 592 |
| 60 | 24 | 18 | 3502 | 31708 | 687 | 656 |
| 61 | 24.2 | 21 | 3551 | 31563 | 706 | 674 |
| 62 | 23.7 | 22 | 3131 | 27649 | 636 | 603 |
| 63 | 23.8 | 23 | 3513 | 30827 | 692 | 664 |
| 64 | 23.9 | 24 | 3560 | 31036 | 715 | 678 |
| 65 | 24 | 34 | 3673 | 29838 | 758 | 724 |
| 66 | 24 | 32 | 3544 | 29226 | 726 | 695 |

TABLE 8

| | | | After recovery thermal treatment process | | | | | | | |
|---|---|---|---|---|---|---|---|---|---|---|
| | | | Ratio of tensile strength | Ratio of proof stress | Bending workability | | Stress corrosion cracking resistance | | Spring bending elastic limit | |
| Test No. | Alloy No. | Process No. | (90 degrees/0 degrees) | (90 degrees/0 degrees) | 90 degree direction Bad Way | 0 degree direction Good Way | Stress corrosion 1 | Stress corrosion 2 | 0 degree direction N/mm$^2$ | 90 degree direction N/mm$^2$ |
| 46 | 5 | B32 | 1.06 | 1.05 | C | A | A | B | | |
| 48 | | B42 | 1.06 | 1.05 | C | A | A | B | 487 | 590 |
| 49 | 6 | A1 | 1.02 | 1.01 | A | A | A | A | 567 | 600 |
| 50 | | A2 | 1.03 | 1.01 | A | A | A | A | 575 | 609 |
| 51 | | A3 | 1.02 | 1.02 | A | A | A | A | | |
| 52 | | A5 | 1.06 | 1.06 | B | A | A | A | 460 | 535 |
| 53 | | A6 | 1.03 | 1.02 | A | A | A | A | 403 | 448 |
| 54 | | B1 | 1.03 | 1.01 | A | A | A | A | | |
| 55 | | B21 | 1.06 | 1.07 | B | A | A | A | 476 | 551 |
| 57 | | B32 | 1.06 | 1.06 | B | A | A | A | | |
| 59 | | B42 | 1.06 | 1.06 | B | A | A | A | 465 | 557 |
| 60 | 7 | A1 | 1.03 | 1.02 | A | A | A | A | | |
| 61 | | A2 | 1.04 | 1.03 | B | A | A | A | | |
| 62 | | A5 | 1.06 | 1.05 | B | A | A | A | | |
| 63 | 8 | A1 | 1.03 | 1.02 | A | A | A | B | | |
| 64 | | A2 | 1.04 | 1.02 | B | A | A | A | | |
| 65 | | A4 | 1.06 | 1.06 | C | B | A | B | | |
| 66 | | A41 | 1.05 | 1.05 | C | A | A | B | | |

TABLE 9

| | | | Average crystal grain diameter after annealing process | After recrystallization thermal treatment process | | | After recovery thermal treatment process | | | | | | | | |
|---|---|---|---|---|---|---|---|---|---|---|---|---|---|---|---|
| | | | | | | | Characteristics of rolled material (0 degree direction) | | | | | | | Characteristics of rolled material (90 degree direction) | |
| | | | | Average crystal grain | Precipitated grains | | | | | | | | | | |
| Test No. | Alloy No. | Process No. | D0 μm | D1 μm | Average grain diameter nm | Proportion of grains of 4 nm to 25 nm % | Tensile strength N/mm$^2$ | Proof stress N/mm$^2$ | Elongation % | Conductivity % IACS | Stress relaxation rate % | Balance index f2 | Stress relaxation balance index f3 | Tensile strength N/mm$^2$ | Proof stress N/mm$^2$ |
| 67 | 8 | A5 | | 8 | 35 | 20 | 599 | 570 | 8 | 23.5 | 28 | 3136 | 26610 | 634 | 601 |
| N1 | 9 | A1 | 3 | 2.6 | 7.4 | 86 | 648 | 622 | 8 | 24.6 | 13 | 3471 | 32376 | 665 | 637 |
| N2 | | A2 | | 2.2 | 5.7 | 75 | 673 | 647 | 7 | 24.7 | 14 | 3579 | 33189 | 690 | 661 |
| N3 | | A3 | | 3.2 | 10 | 95 | 630 | 605 | 10 | 24.6 | 12 | 3437 | 32243 | 645 | 619 |
| N4 | | A5 | | 8 | 30 | 35 | 596 | 560 | 11 | 24 | 17 | 3241 | 29527 | 622 | 590 |
| N5 | | A6 | | 2.6 | 7.5 | 92 | 663 | 624 | 6 | 24.3 | 26 | 3464 | 29802 | 687 | 644 |
| 69 | 11 | C1 | | 3.1 | 10 | 95 | 618 | 597 | 9 | 29 | 16 | 3628 | 33247 | 633 | 606 |
| 70 | 12 | C1 | | 2.3 | 9.5 | 94 | 666 | 641 | 7 | 23.1 | 21 | 3425 | 30442 | 691 | 662 |
| 71 | 13 | C1 | | 2.5 | 11 | 94 | 639 | 616 | 8 | 24.4 | 14 | 3409 | 31613 | 656 | 630 |
| 72 | 14 | C1 | | 2.2 | 7.5 | 90 | 634 | 610 | 8 | 26.6 | 14 | 3531 | 32749 | 651 | 622 |
| 73 | 15 | C1 | | 1.8 | 7 | 87 | 693 | 669 | 6 | 22.8 | 24 | 3508 | 30578 | 715 | 690 |
| 74 | 16 | C1 | | 1.9 | 6.5 | 85 | 683 | 658 | 6 | 23.3 | 33 | 3495 | 28605 | 711 | 685 |
| N6 | 171 | C1 | 1.6 | 1.4 | 5.5 | 78 | 668 | 644 | 6 | 24.8 | 22 | 3526 | 31143 | 691 | 664 |
| N7 | 172 | C1 | | 1.9 | 6.5 | 82 | 631 | 602 | 7 | 27.8 | 20 | 3560 | 31841 | 651 | 622 |
| N8 | 173 | C1 | 1.8 | 1.5 | 6 | 80 | 675 | 646 | 6 | 24 | 21 | 3505 | 31155 | 702 | 666 |
| N9 | 174 | C1 | 4.5 | 3.8 | 12.5 | 90 | 604 | 578 | 9 | 31.1 | 19 | 3672 | 33044 | 620 | 595 |
| N10 | 175 | C1 | | 3.2 | 10 | 92 | 624 | 597 | 8 | 28.4 | 17 | 3591 | 32719 | 641 | 612 |

TABLE 10

| | | | After recovery thermal treatment process | | | | | | | |
|---|---|---|---|---|---|---|---|---|---|---|
| | | | Ratio of tensile strength | Ratio of proof stress | Bending workability | | Stress corrosion cracking resistance | | Spring bending elastic limit | |
| Test No. | Alloy No. | Process No. | (90 degrees/0 degrees) | (90 degrees/0 degrees) | 90 degree direction Bad Way | 0 degree direction Good Way | Stress corrosion 1 | Stress corrosion 2 | 0 degree direction N/mm$^2$ | 90 degree direction N/mm$^2$ |
| 67 | 8 | A5 | 1.06 | 1.05 | B | A | A | B | | |
| N1 | 9 | A1 | 1.03 | 1.02 | A | A | A | A | 577 | 606 |
| N2 | | A2 | 1.03 | 1.02 | A | A | A | A | | |
| N3 | | A3 | 1.02 | 1.02 | A | A | A | A | | |
| N4 | | A5 | 1.04 | 1.05 | A | A | A | A | | |
| N5 | | A6 | 1.04 | 1.03 | A | A | A | A | | |
| 69 | 11 | C1 | 1.02 | 1.02 | A | A | A | A | | |
| 70 | 12 | C1 | 1.04 | 1.03 | B | A | A | B | | |
| 71 | 13 | C1 | 1.03 | 1.02 | A | A | A | A | | |
| 72 | 14 | C1 | 1.03 | 1.02 | A | A | A | A | | |
| 73 | 15 | C1 | 1.03 | 1.03 | B | A | A | B | | |
| 74 | 16 | C1 | 1.04 | 1.04 | B | A | A | B | | |
| N6 | 171 | C1 | 1.03 | 1.03 | B | A | A | A | | |
| N7 | 172 | C1 | 1.03 | 1.03 | A | A | A | A | 576 | 602 |
| N8 | 173 | C1 | 1.04 | 1.03 | A | A | A | A | 615 | 643 |
| N9 | 174 | C1 | 1.03 | 1.03 | A | A | A | A | 533 | 567 |
| N10 | 175 | C1 | 1.03 | 1.03 | A | A | A | A | 568 | 600 |

TABLE 11

| | | | Average crystal grain diameter after annealing process | After recrystallization thermal treatment process | | | After recovery thermal treatment process | | | | | | | | |
|---|---|---|---|---|---|---|---|---|---|---|---|---|---|---|---|
| | | | | Average crystal grain | Precipitated grains | | Characteristics of rolled material (0 degree direction) | | | | | | | Characteristics of rolled material (90 degree direction | |
| Test No. | Alloy No. | Process No. | D0 μm | diameter D1 μm | Average grain diameter nm | Proportion of grains of 4 nm to 25 nm % | Tensile strength N/mm$^2$ | Proof stress N/mm$^2$ | Elongation % | Conductivity % IACS | Stress relaxation rate % | Balance index f2 | Stress relaxation balance index f3 | Tensile strength N/mm$^2$ | Proof stress N/mm$^2$ |
| 75 | 21 | C1 | 8 | 2.8 | 11 | 95 | 622 | 600 | 8 | 26 | 36 | 3425 | 27403 | 637 | 613 |
| 76 | 22 | C1 | | 5.6 | | | 598 | 566 | 8 | 25.1 | 27 | 3236 | 27645 | 634 | 610 |
| 77 | 23 | C1 | | 1.3 | 3.8 | 40 | 660 | 638 | 6 | 24.4 | 28 | 3456 | 29323 | 700 | 672 |
| 78 | 24 | C1 | | 1.1 | 3.1 | 25 | 699 | 673 | 5 | 23.4 | 34 | 3550 | 28843 | 748 | 720 |
| 79 | 25 | C1 | | 1.1 | 3.3 | 30 | 696 | 670 | 5 | 24 | 33 | 3580 | 29305 | 743 | 714 |
| 80 | 26 | C1 | | 2.2 | 7 | 90 | 650 | 628 | 7 | 25.4 | 37 | 3505 | 27822 | 675 | 651 |
| 81 | 27 | C1 | | 5.5 | 15 | 86 | 560 | 530 | 8 | 27.5 | 19 | 3172 | 28544 | 584 | 550 |
| 82 | 28 | C1 | | 4 | 16 | 84 | 572 | 543 | 7 | 27 | 22 | 3180 | 28087 | 594 | 563 |
| 83 | 29 | C1 | | 1.9 | 7.4 | 90 | 663 | 630 | 6 | 23.1 | 29 | 3378 | 28461 | 704 | 665 |
| 84 | 30 | C1 | 5.4 | 3.8 | 12 | 93 | 552 | 524 | 8 | 28 | 19 | 3155 | 28391 | 565 | 536 |
| 85 | 31 | C1 | Large cracks generated during hot rolling, subsequent investigation stopped | | | | | | | | | | | | |
| 86 | 33 | C1 | 7 | 5.5 | 14 | 93 | 557 | 529 | 7 | 30.3 | 25 | 3281 | 28411 | 572 | 545 |
| 87 | 35 | C1 | | 1.7 | 6.5 | 85 | 683 | 644 | 5 | 22.2 | 24 | 3379 | 29457 | 729 | 684 |
| 88 | 36 | C1 | | 1.2 | 4 | 60 | 702 | 671 | 5 | 21.6 | 26 | 3426 | 29469 | 758 | 723 |
| 89 | 37 | C1 | | 1.1 | 2.9 | 20 | 688 | 655 | 3 | 23.8 | 32 | 3457 | 28508 | 741 | 710 |
| N11 | 38 | C1 | | 1.1 | 2.7 | 25 | 691 | 654 | 4 | 23.7 | 33 | 3499 | 28637 | 742 | 711 |
| N12 | 39 | C1 | | 1.1 | 2.6 | 20 | 686 | 651 | 4 | 24.4 | 35 | 3524 | 28412 | 738 | 707 |
| N15 | 42 | C1 | 5.5 | 3.8 | 12 | 90 | 569 | 546 | 7 | 30.2 | 28 | 3346 | 28390 | 585 | 558 |

TABLE 12

| | | | After recovery thermal treatment process | | | | | | | |
|---|---|---|---|---|---|---|---|---|---|---|
| | | | Ratio of tensile strength | Ratio of proof stress | Bending workability | | Stress corrosion cracking resistance | | Spring bending elastic limit | |
| Test No. | Alloy No. | Process No. | (90 degrees/0 degrees) | (90 degrees/0 degrees) | 90 degree direction Bad Way | 0 degree direction Good Way | Stress corrosion 1 | Stress corrosion 2 | 0 degree direction N/mm$^2$ | 90 degree direction N/mm$^2$ |
| 75 | 21 | C1 | 1.02 | 1.02 | A | A | A | A | | |
| 76 | 22 | C1 | 1.06 | 1.08 | B | A | A | A | 495 | 577 |
| 77 | 23 | C1 | 1.06 | 1.05 | C | B | A | A | 578 | 642 |
| 78 | 24 | C1 | 1.07 | 1.07 | C | A | A | A | 601 | 679 |
| 79 | 25 | C1 | 1.07 | 1.07 | C | B | A | B | | |
| 80 | 26 | C1 | 1.04 | 1.04 | A | A | A | A | | |
| 81 | 27 | C1 | 1.04 | 1.04 | A | A | A | A | 462 | 506 |
| 82 | 28 | C1 | 1.04 | 1.04 | A | A | A | A | 476 | 522 |
| 83 | 29 | C1 | 1.06 | 1.06 | C | A | B | C | | |
| 84 | 30 | C1 | 1.02 | 1.02 | A | A | A | A | 446 | 480 |
| 85 | 31 | C1 | | | | | | | | |
| 86 | 33 | C1 | 1.03 | 1.03 | A | A | A | A | 450 | 498 |
| 87 | 35 | C1 | 1.07 | 1.06 | C | B | A | B | | |
| 88 | 36 | C1 | 1.08 | 1.08 | C | B | B | B | | |
| 89 | 37 | C1 | 1.08 | 1.08 | C | B | A | A | | |
| N11 | 38 | C1 | 1.07 | 1.09 | C | B | A | A | | |
| N12 | 39 | C1 | 1.08 | 1.09 | C | A | A | A | | |
| N15 | 42 | C1 | 1.03 | 1.02 | A | A | A | A | 448 | 498 |

The tensile strength, the proof stress and the elongation were measured using the methods regulated in JIS Z 2201 and JIS Z 2241, and the test specimens had a shape of No. 5 test specimen.

The conductivity was measured using a conductivity meter (SIGMATEST D2.068) manufactured by Foerster Japan Limited. Meanwhile, in the specification, "electric conduction" and "conduction" are used with the same meaning. In addition, since thermal conduction and electric conduction have a strong correlation, higher conductivity indicates more favorable thermal conduction.

The bending workability was evaluated using a W bend test regulated in JIS H 3110. A bend test (W bend test) was carried out in the following manner. The bend radius (R) at the front end of a bent jig was set to 0.67 times (0.3 mm×0.67=0.201 mm, bend radius=0.2 mm), 0.33 times (0.3 mm×0.33=0.099 mm, bend radius=0.1 mm) and 0 times (0.3 mm×0=0 mm, bend radius=0 mm) of the thickness of a material. Sampling was carried out in a direction forming 90 degrees with respect to the rolling direction which is called 'bad way' and in a direction forming 0 degrees with respect to the rolling direction which is called 'good way'. The bending workability was determined based on whether or not cracking was observed using a 20-times stereomicroscope, copper alloys in which the bend radius was 0.33 times the thickness of the material and cracking did not occur were evaluated to be A, copper alloys in which the bend radius was 0.67 times the thickness of the material and cracking did not occur were evaluated to be B, and copper alloys in which the bend radius was 0.67 times the thickness of the material and cracking did not occur were evaluated to be C.

The stress relaxation rate was measured in the following manner. A cantilever screw-type jig was used in the stress relaxation test of a test specimen material. The shape of the test specimen was set to a sheet thickness of t×a width of 10 mm×a length of 60 mm. The stress loaded on the test specimen was set to 80% of the 0.2% proof stress, and the test specimen was exposed for 1000 hours in an atmosphere at 150° C. The stress relaxation rate was obtained using Stress relaxation rate=(dislocation after opening/dislocation under stress load)×100(%).

The invention aims to be excellent particularly in terms of a stress relaxation property, the standards for the stress relaxation property are more strict than usual, and the stress relaxation characteristics are said to be excellent at a stress relaxation rate of 20% or less, favorable at more than 20% to 25%, available depending on the operation environment at more than 25% to 30%, and unavailable in a high-temperature environment in which heat generation and the like occur at more than 30%, particularly, at more than 35%.

The stress corrosion cracking resistance was measured using a test container and a test solution regulated in JIS H 3250, and a solution obtained by mixing the same amounts of ammonia water and water.

First, mainly, a residual stress was added to a rolled material, and the stress corrosion cracking resistance was evaluated. The test specimen bent into a W shape at R (radius 0.6 mm) that was twice the sheet thickness was exposed to an ammonia atmosphere, and evaluated using the method used in the evaluation of the bending workability. The evaluation was carried out using a test container and a test solution regulated in JIS H 3250. The test specimen was exposed to ammonia using a solution obtained by mixing the same amounts of ammonia water and water, pickled using sulfuric acid, the occurrence of cracking was investigated using a 10-times stereomicroscope, and the stress corrosion cracking resistance was evaluated. Copper alloys in which cracking did not occur in 48-hour exposure were evaluated to be A as being excellent in terms of stress corrosion cracking resistance, copper alloys in which cracking occurred in 48-hour exposure but cracking did not occur in 24-hour exposure were evaluated to be B as being favorable in terms of stress corrosion cracking resistance (no practical problem), and copper alloys in which cracking occurred in 24-hour exposure were evaluated to be C as being poor in terms of stress corrosion cracking resistance (practically somewhat problematic). The results are described in the column of stress corrosion 1 of the stress corrosion cracking resistance in Tables 3 to 12.

In addition, separately from the above evaluation, the stress corrosion cracking resistance was evaluated using another method.

In another stress corrosion cracking resistance test, in order to investigate the sensitivity of stress corrosion cracking against additional stress, a resin cantilever screw-type jig was used, a rolled material to which a bend stress as large as 80% of the proof stress was added was exposed to the ammonia atmosphere, and the stress corrosion cracking resistance was evaluated from the stress relaxation rate. That is, when fine cracks occur, the rolled material cannot return to the original state, and, when the degree of the cracks increases, the stress relaxation rate increases, and therefore the stress corrosion cracking resistance can be evaluated. Copper alloys in which the stress relaxation rate was 25% or less in 48-hour exposure were evaluated to be A as being excellent in terms of stress corrosion cracking resistance, copper alloys in which the stress relaxation rate was more than 25% in 48-hour exposure but the stress relaxation rate was 25% or less in 24-hour exposure were evaluated to be B as being favorable in terms of stress corrosion cracking resistance (no practical problem), and copper alloys in which the stress relaxation rate was more than 25% in 24-hour exposure were evaluated to be C as being poor in terms of stress corrosion cracking resistance (practically somewhat problematic). The results are described in the column of stress corrosion 2 of the stress corrosion cracking resistance in Tables 3 to 12.

Meanwhile, the stress corrosion cracking resistance required in the application is a characteristic with an assumption of high reliability and strict cases.

The spring bending elastic limit was measured using a method described in JIS H 3130, evaluated using a repeated deflection test, and the test was carried out until the permanent deflection amount exceeded 0.1 mm.

The average grain diameter of recrystallized grains was measured by selecting an appropriate magnification depending on the sizes of crystal grains in 600-times, 300-times and 150-times metal microscopic photographs, and using a quadrature method of the methods for estimating average grain size of wrought copper and copper-alloys in JIS H 0501. Meanwhile, twin crystals are not considered as crystal grains. Grains that could not be easily determined using a metal microscope were determined using an electron back scattering diffraction pattern (FE-SEM-EBSP) method. That is, a JSM-7000F manufactured by JEOL Ltd. was used as the FE-SEM, TSL solutions OIM-Ver. 5.1 was used for analysis, and the average crystal grain size was obtained from grain maps with analysis magnifications of 200 times and 500 times. The quadrature method (JIS H 0501) was used as the method for computing the average crystal grain diameter.

Meanwhile, a crystal grain is elongated due to rolling, but the volume of crystal grains rarely changes due to rolling. When the average values of the average crystal grain diameters measured using the respective quadrature methods are obtained in cross-sections obtained by cutting a plate material in parallel to the rolling direction and vertically to the rolling direction, it is possible to estimate the average crystal grain diameter in the recrystallization stage.

The average grain diameter of precipitates was obtained in the following manner. On transmission electron images obtained using 500,000-times and 150,000-times (the detection limits were 1.0 nm and 3 nm respectively) TEMs, the contrasts of precipitates were elliptically approximated using image analysis software "Win ROOF", the synergetic average values of the long axes and the short axes of all precipitated grains in a view were obtained, and the average value of the synergetic average values was considered as the average grain diameter. Meanwhile, the detection limits were set to 1.0 nm and 3 nm respectively in measurements of 500,000 times and 150,000 times, grains below the detection limits were treated as noise, and were not included in the computation of the average grain diameter. Meanwhile, the average grain diameters were obtained at 500,000 times for grains as large as approximately 8 nm or less, and at 150,000 times for grains as large as approximately 8 nm or more. In the case of a transmission electron microscope, since the dislocation density is high in a cold-worked material, it is difficult to obtain the precise information of precipitates. In addition, since the sizes of precipitates do not change due to cold working, recrystallized grains before the cold finishing rolling process and after the recrystallization thermal treatment process were observed. The grain diameters were measured at two places at ¼ sheet depth from the front and rear surfaces of the rolled material, and the values measured at the two places were averaged.

The test results will be described below.

(1) The copper alloy sheet which is the first invention alloy, and was obtained through cold finishing rolling of a rolled material in which the average crystal grain diameter after the recrystallization thermal treatment process was 1.2 μm to 5.0 μm, the average particle diameter of precipitates was 4.0 nm to 25.0 nm or the proportion of precipitates having a grain diameter of 4.0 nm to 25.0 nm in the precipitates was 70% or more is excellent in terms of tensile strength, proof stress, conductivity, bending workability, stress corrosion cracking resistance and the like (refer to Test Nos. 19, and the like).

(2) The copper alloy sheet which is the second invention alloy, and was obtained through cold finishing rolling of a rolled material in which the average crystal grain diameter after the recrystallization thermal treatment process was 1.2 μm to 5.0 μm, the average particle diameter of precipitates was 4.0 nm to 25.0 nm or the proportion of precipitates having a grain diameter of 4.0 nm to 25.0 nm in the precipitates was 70% or more is excellent in terms of tensile strength, proof stress, conductivity, bending workability, stress corrosion cracking resistance and the like (refer to Test Nos. 42, 53 and the like).

(3) The copper alloys which are the third and fourth invention alloys, and were obtained through cold finishing rolling of a rolled material in which the average crystal grain diameter after the recrystallization thermal treatment process was 1.2 μm to 5.0 μm, the average particle diameter of precipitates was 4 nm to 25 nm or the proportion of precipitates having a grain diameter of 4 nm to 25 nm in the precipitates was 70% or more are excellent particularly in terms of tensile strength, and favorable in terms of proof stress, conductivity, bending workability, stress corrosion cracking resistance and the like (refer to Test Nos. N6, N7, N8 and the like).

(4) It is possible to obtain a copper alloy sheet which is one of the first to fourth invention alloys, was obtained through cold finishing rolling of a rolled material in which the average crystal grain diameter after the recrystallization thermal treatment process was 1.2 μm to 5.0 μm, the average particle diameter of precipitates was 4.0 nm to 25.0 nm or the proportion of precipitates having a grain diameter of 4.0 nm to 25.0 nm in the precipitates was 70% or more, and in which the conductivity is 21% IACS or more, the tensile strength is 580 $N/mm^2$ or more, $28500 \leq f3$, the ratio of the tensile strength in a direction forming 0 degrees with the rolling direction to the tensile strength in a direction forming 90 degrees with the rolling direction is 0.95 to 1.05, and the ratio of the proof stress in a direction forming 0 degrees with the rolling direction to the proof stress in a direction forming 90 degrees with the rolling direction is 0.95 to 1.05 (refer to Test Nos. 19, 25, 42, 53 and the like).

(5) The copper alloy sheet which is one of the first to fourth invention alloys, and was obtained through cold finishing rolling and a recovery thermal treatment of a rolled material in which the average crystal grain diameter after the recrystallization thermal treatment process was 1.2 μm to 5.0 μm, the average particle diameter of precipitates was 4.0 nm to 25.0 nm or the proportion of precipitates having a grain diameter of 4.0 nm to 25.0 nm in the precipitates was 70% or more is excellent in terms of elongation, conductivity, bending workability, isotropy, stress relaxation characteristics, a spring bending elastic limit and the like (refer to Test Nos. 1, 2, 14, 15, 20, 21, 36, 37, 49, 50, 60, 61, N6, N7, N8 and the like).

(6) It is possible to obtain a copper alloy sheet which is one of the first to fourth invention alloys, was obtained through cold finishing rolling and a recovery thermal treatment of a rolled material in which the average crystal grain diameter after the recrystallization thermal treatment process was 1.2 μm to 5.0 μm, the average particle diameter of precipitates was 4.0 nm to 25.0 nm or the proportion of precipitates having a grain diameter of 4.0 nm to 25.0 nm in the precipitates was 70% or more, and in which the conductivity is 21% IACS or more, the tensile strength is 580 N/mm$^2$ or more, 28500≤f3, the ratio of the tensile strength in a direction forming 0 degrees with the rolling direction to the tensile strength in a direction forming 90 degrees with the rolling direction is 0.95 to 1.05, and the ratio of the proof stress in a direction forming 0 degrees with the rolling direction to the proof stress in a direction forming 90 degrees with the rolling direction is 0.95 to 1.05 (refer to Test Nos. 1, 2, 14, 15, 20, 21, 36, 37, 49, 50, 60, 61, N6, N7, N8 and the like).

(7) It is possible to obtain a copper alloy sheet described in the above (1) and (2) using manufacturing conditions which sequentially include the hot rolling process, the second cold rolling process, the recrystallization thermal treatment process and the cold finishing rolling process, and in which the hot rolling initial temperature of the hot rolling process is 800° C. to 920° C., the cooling rate of the copper alloy material in a temperature range from a temperature after final rolling to 350° C. or 650° C. to 350° C. is 1° C./second or more, the cold working rate in the second cold rolling process is 55% or more, in the recrystallization thermal treatment, the peak temperature Tmax (° C.) of the rolled material is 540≤Tmax≤780, the holding time tm (min) is 0.04≤tm≤2, and the thermal treatment index It is 450≤It≤580 (refer to Test Nos. 19, 25, 42, 53 and the like).

(8) It is possible to obtain a copper alloy sheet described in the above (4) using manufacturing conditions which sequentially include the hot rolling process, the second cold rolling process, the recrystallization thermal treatment process, the cold finishing rolling process and the recovery thermal treatment process and in which the hot rolling initial temperature of the hot rolling process is 800° C. to 940° C., the cooling rate of the copper alloy material in a temperature range from a temperature after final rolling to 350° C. or 650° C. to 350° C. is 1° C./second or more, the cold working rate in the second cold rolling process is 55% or more, in the recrystallization thermal treatment, the peak temperature Tmax (° C.) of the rolled material is 550≤Tmax≤790, the holding time tm (min) is 0.04≤tm≤2, the thermal treatment index It is 460≤It≤580, in the recovery thermal treatment, the peak temperature Tmax2 (° C.) of the rolled material is 160≤Tmax2≤650, the holding time tm2 (min) is 0.02≤tm≤2200, and the thermal treatment index It is 100≤It≤360 (refer to Test Nos. 1, 2, 14, 15, 20, 21, 36, 37, 49, 50, 60, 61, N6, N7, N8 and the like).

In a case in which the invention alloy was used, the following results were obtained.

(1) In Manufacturing Process A in which a mass production facility was used and Manufacturing Process B in which an experimental facility was used, similar characteristics were obtained as long as the manufacturing conditions were similar (refer to Test Nos. 1, 36 and the like).

(2) In the first invention alloy and the second invention alloy, the action that suppresses the growth of crystal grains worked, crystal grains became fine, and the strength became high in the second invention alloy which contained Co (refer to Test Nos. 1, 14, 20, 36, 49, 60 and the like).

(3) When the manufacturing conditions are within the set condition ranges, the relational formula E1: $\{0.05\times([Zn]-3)+0.25\times([Sn]-0.3)\}\leq[Ni]$ is satisfied, and [Ni]/[P] is 10 to 65, the stress relaxation characteristics become excellent as the [Ni] value increases (refer to Test Nos. 20, 49 and the like).

More preferably, when the composition index f1 is within 20 to 29.5, the relational formula E2: $\{0.05\times([Zn]-3)+0.25\times([Sn]-0.3)\}\leq[Ni]/1.2$ is satisfied, and [Ni]/[P] is 12 to 50, the stress relaxation characteristics become excellent as the [Ni] value increases. Furthermore, when the composition index f1 is within 20 to 28.5, the relational formula E3: $\{0.05\times([Zn]-3)+0.25\times([Sn]-0.3)\}\leq[Ni]/1.4$ is satisfied, and [Ni]/[P] is 15 to 40, the stress relaxation characteristics become superior as the [Ni] value increases. At the same time, the conductivity is high, the bending workability is also excellent, and the isotropy of the strength is within a range of 0.99 to 1.04, which makes the copper alloy sheet excellent (refer to Test Nos. 14, N1, 72 and the like).

(4) As the average recrystallized grain diameter after the recrystallization thermal treatment process decreases, the stress relaxation characteristics deteriorate (refer to Test Nos. 3, 4, 22, 65, 66 and the like). That is, even when the strength increases in accordance with the miniaturization of crystal grains, stress relaxation characteristics commensurate with the strength improvement are not obtained.

(5) When the ratio of the tensile strength and the ratio of the proof stress between the directions forming 0 degrees and 90 degrees with respect to the rolling direction are 1.04 or less, and, furthermore, 1.03 or less, the bending workability improves (refer to Test Nos. 1, 2, 5, 14, 15, 17 and the like). In addition, since the spring bending elastic limit is isotropic, the spring bending elastic limit is high both in the direction forming 0 degrees and in the direction forming 90 degrees with respect to the rolling direction (refer to Test Nos. 1, 2, 14, 15 and the like).

(6) When the average recrystallized grain diameter after the recrystallization thermal treatment process is 1.5 μm to 4.0 μm, and particularly 1.8 μm to 3.0 μm, the respective characteristics of tensile strength, proof stress, conductivity, bending workability, stress corrosion cracking resistance and stress relaxation characteristics are favorable (refer to Test Nos. 1, 2, 20, 21 and the like). In a case in which the stress relaxation characteristics matter, the average recrystallized grain diameter is preferably 2.4 μm to 4.0 μm (refer to Test Nos. 14, 15, 17, 23, 51, N3 and the like).

(7) When the average recrystallized grain diameter after the recrystallization thermal treatment process is smaller than 1.5 μm, and particularly 1.2 μm, the bending workability and the stress relaxation characteristics deteriorate. When the average recrystallized grain diameter is smaller than 1.2 μm, the bending workability or the isotropy does not improve sufficiently even when the final finishing rolling rate is decreased (refer to Test Nos. 3, 4, 16, 22, 38, 39, 65, 66 and the like).

(8) When the average recrystallized grain diameter after the recrystallization thermal treatment process is larger than 3.0 μm or 4.0 μm, the tensile strength decreases (refer to Test Nos. 5, 17 and the like), and when the average recrystallized grain diameter after the recrystallization thermal treatment process is larger than 5.0 μm, the isotropy deteriorates (refer to Test Nos. 6, 18 and the like).

(9) The conductivity slightly deteriorates as the peak temperature of the recrystallization thermal treatment process increases within the set condition range, but it is considered that, as the temperature increases, a result of a slight increase in the proportion of the precipitates of P, Ni and Co that form solid solutions again is obtained. However, when the peak temperature of the recrystallization thermal treatment process excessively increases, the number of precipitates that suppress the growth of crystal grains decreases, the crystal grain diameter increases, the tensile strength decreases, and the conductivity also deteriorates (refer to Test Nos. 1, 2, 3, 4, 5, 6, 14, 15, 16, 17, 18 and the like). When the thermal treatment is carried out under appropriate conditions, since fine precipitates form solid solutions again, it is considered that the conductivity decreases extremely slightly, and the ductility or the bending characteristics improve. When Fe is contained, the precipitated grain diameter decreases more than in a case in which Co is contained, and the average crystal grain diameter decreases. Therefore, an alloy having a high strength is obtained.

(10) When the thermal treatment conditions of the recrystallization thermal treatment process are appropriate, the precipitated grain diameter is 6 nm to 12 nm on average, and the proportion of precipitated grains having a diameter of 4 nm to 25 nm increases. Due to the effect that suppresses the growth of crystal grains, recrystallized grains of 2 μm to 3 μm are obtained as a result (refer to Test Nos. 49, 50, 51 and the like). When the precipitated grain diameter is 6 nm to 12 nm on average, and the proportion of precipitated grains having a diameter of 4 nm to 25 nm is high, it is considered that there is a favorable influence on the stress relaxation characteristics. On the other hand, in a case in which the peak temperature in the recrystallization thermal treatment process is low, the recrystallized grains begin to grow, the precipitated grain diameter is as fine as 3 nm to 4 nm, the recrystallized grains remain fine in cooperation with the effect that suppresses the growth of the recrystallized grains using the precipitated grains, and the strength increases, but the strength becomes anisotropic, and the bending workability and the stress relaxation characteristics deteriorate (refer to Test Nos. 38, 65 and the like).

(11) When the thermal treatment index It in the recrystallization thermal treatment process is larger than 580, the average grain diameter of precipitated grains after the recrystallization thermal treatment process increases, it is not possible to suppress the growth of the recrystallized grains, the recrystallized grains grow, and the tensile strength, the stress relaxation characteristics and the conductivity decrease. In addition, the isotropy of the tensile strength or the proof stress deteriorates (refer to Test Nos. 6, 18, 24 and the like).

(12) When It is smaller than 450, the average grain diameter of precipitated grains decreases, there is a tendency for crystal grains to become excessively fine, the bending workability and the stress relaxation characteristics deteriorate, and the strength becomes anisotropic (refer to Test Nos. 38, 65 and the like).

(13) When the cooling rate after hot rolling is below the set condition range, the average grain diameter of the precipitated grains slightly increases, the precipitates turn into an inhomogeneous precipitation state, the tensile strength is low, and the stress relaxation characteristics also deteriorate (refer to Test Nos. 9, 27, 44 and the like).

(14) In a case in which the temperature condition of the annealing process is 570° C. for 4 hours, the relationship of $D0 \leq D1 \times 4 \times (RE/100)$ cannot be satisfied, or, when the cold working rate in the second cold rolling process is below the set condition range, the recrystallized grains after the recrystallization thermal treatment process turn into a mixed-grain state in which crystal grains having a large recrystallized grain diameter and crystal grains having a small recrystallized grain diameter become mixed. As a result, the average crystal grain diameter slightly increases, the strength becomes anisotropic, and the stress relaxation characteristics and the bending workability deteriorate (Test Nos. 11, 13, 29, 31 and the like).

Regarding the composition, the following results were obtained.

(1) When the content of P is below the condition range of the invention alloy, the average crystal grain diameter after the recrystallization thermal treatment process increases, and the balance index f2 and the stress relaxation balance index f3 decrease. The tensile strength decreases, and the isotropy also deteriorates (refer to Test Nos. 76 and the like).

(2) When the contents of P and Co are above the condition range of the invention alloy, the average grain diameter of the precipitated grains after the recrystallization thermal treatment process decreases, and the average recrystallized grain diameter excessively decreases. The balance index f2, the isotropy, the bending workability and the stress relaxation rate deteriorate (refer to Test Nos. 77, 78, 79 and the like).

(3) When the contents of Zn or Sn, or the composition index f1 is below the condition range of the invention alloy, the average crystal grain diameter after the recrystallization thermal treatment process increases, the tensile strength decreases, and the balance index f2 and the stress relaxation balance index f3 decrease. In addition, when the content of Zn is small, the stress relaxation rate deteriorates (refer to Test Nos. 81, 82, 84, 86 and the like).

(4) When the content of Zn is above the condition range of the invention alloy, the stress relaxation balance index f3 is small, and the isotropy, the bending workability and the stress relaxation rate deteriorate. In addition, the stress corrosion cracking resistance also deteriorates (refer to Test Nos. 83 and the like).

(5) When the content of Sn is high, cracking is likely to occur during hot rolling. Co being contained seems to have an effect that prevents cracking during hot rolling (refer to Test Nos. 60, 74, 85, 87 and the like).

(6) When the composition index f1 is $21.0 \leq f1 \leq 29.5$, the respective characteristics of the balance index f2, the stress relaxation balance index f3, the tensile strength, the proof stress, the conductivity, the bending workability, the stress corrosion cracking resistance and the stress relaxation characteristics are favorable (refer to Test Nos. 1, 2, 5, 49, 50, 51 and the like).

(7) When the composition index f1 is below the condition range of the invention alloy, the average grain diameter after the recrystallization thermal treatment process is large, and the tensile strength is low (refer to Test Nos. 86 and the like).

(8) When the composition index f1 is above the condition range of the invention alloy, the conductivity is low, the stress relaxation balance index f3 is small, and the isotropy is also poor. In addition, the stress corrosion cracking resistance and the stress relaxation rate are also poor (refer to Test Nos. 87, 88 and the like).

(9) When the relational formula E1 of $(0.05\times([Zn]-3)+0.25\times([Sn]-0.3)\leq[Ni])$ is satisfied, the stress relaxation characteristics are excellent (refer to Test Nos. 1, 36 and the like), and, when the relational formula E3 of $(0.05\times([Zn]-3)+0.25\times([Sn]-0.3)\leq[Ni]/1.4)$ is satisfied, the stress relaxation characteristics are superior (refer to Test Nos. 20, 49 and the like). Conversely, when the relational formula E1 of $(0.05\times([Zn]-3)+0.25\times([Sn]-0.3)\leq[Ni])$ is not satisfied, the stress relaxation characteristics commensurate with the amount of Ni cannot be obtained (refer to Alloy Nos. 16, 26, 29 and the like).

(10) When the content of Fe exceeds 0.04 mass %, and the sum of the content of Co and double the content of Fe exceeds 0.08 mass % (that is, $[Co]+2\times[Fe]\geq0.08$), and more than 0.03 mass % of Cr is contained, the average grain diameter of the precipitated grains after the recrystallization thermal treatment process decreases, the average crystal grain diameter decreases, the bending workability and the isotropy are poor, and the stress relaxation rate is poor (refer to Test Nos. 89 and the like) (refer to Alloy Nos. 37, 38, 39 and the like).

When [Ni]/[P] is smaller than 10 and larger than 65, the stress relaxation characteristics commensurate with the content of Ni cannot be obtained (refer to Alloy Nos. 21 to 23, 25, and 26). In addition, when [Ni]/[P] is 12 or more, preferably 15 or more and 50 or less, preferably or less, excellent stress relaxation characteristics commensurate with the amount of Ni are exhibited.

When the value of the composition index f1 is larger than 20, the strength, the stress relaxation characteristics, the balance index f2 and the stress relaxation balance index f3 become excellent, and, as the composition index f1 increases, the strength improves. When the value of the composition index f1 is smaller than 32, the bending workability, the stress corrosion cracking resistance, the stress relaxation characteristics and the conductivity become favorable. When the value of the composition index is 30.5 or less, furthermore, 29.5 or less, the characteristics become superior.

(11) The following results were obtained depending on the composition and hot rolling.

Since Test No. 85 and Alloy No. 31 contained 2.6 mass % of Sn, cracked edges were generated during hot rolling, and the subsequent processes could not proceed. In addition, since Test No. 87 and Alloy No. 35 contained 2.28 mass % of Sn and did not contain Co, cracked edges were generated during hot rolling, but the processes proceeded after the cracked edges were removed. Since Test No. 74 and Alloy No. 16 contained 2.37 mass % of Sn and contained Co, and Test No. 60 and Alloy No. 7 contained 2.26 mass % of Sn and contained Co, cracked edges were not generated during hot rolling.

INDUSTRIAL APPLICABILITY

The copper alloy sheet of the invention has high strength, favorable corrosion resistance, and excellently balanced conductivity, stress relaxation rate, tensile strength and elongation, isotropic tensile strength and isotropic proof stress. Therefore, the copper alloy sheet of the invention can be preferably applied as a constituent material and the like for connectors, terminals, relays, springs, switches, sliding pieces, bushes, bearings, liners, a variety of clasps, filters in a variety of strainers, and the like.

The invention claimed is:

1. A method for manufacturing a copper alloy sheet, sequentially comprising:

subjecting an ingot to a hot rolling process to obtain a copper alloy material;

subjecting the copper alloy material to a cold rolling process;

subjecting the copper alloy material to a recrystallization thermal treatment process; and subjecting the copper alloy material to a cold finishing rolling process, wherein a hot rolling initial temperature of the hot rolling process is 800° C. to 920° C., a cooling rate of the copper alloy material in a temperature range from a temperature after final rolling to 350° C. or 650° C. to 350° C. is 1° C./second or more, wherein a cold working rate in the cold rolling process is 55% or more, wherein the recrystallization thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, wherein in the recrystallization thermal treatment process, when a peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), $540\leq Tmax\leq780$, $0.04\leq tm\leq2$, and $450\leq\{Tmax-40\times tm^{-1/2}-50\times(1-RE/100)^{1/2}\}\leq580$, wherein an average crystal grain diameter of the copper alloy material before the cold finishing rolling process is 1.2 μm to 5.0 μm, round or oval precipitates are present in the copper alloy material before the cold finishing rolling process, an average grain diameter of the precipitates is 4.0 nm to 25.0 nm or a proportion of precipitates having a grain diameter of 4.0 nm to 25.0 nm in the precipitates is 70% or more, wherein the copper alloy sheet contains 5.0 mass % to 12.0 mass % of Zn, 1.1 mass % to 2.5 mass % of Sn, 0.01 mass % to 0.09 mass % of P and 0.6 mass % to 1.5 mass % of Ni with a remainder of Cu and inevitable impurities, and wherein a content of Zn [Zn] mass %, a content of Sn [Sn] mass %, a content of P [P] mass % and a content of Ni [Ni] mass % have a relationship of $20\leq[Zn]+7\times[Sn]+15\times[P]+4.5\times[Ni]\leq32$.

2. A method for manufacturing a copper alloy sheet, sequentially comprising:

subjecting an ingot to a hot rolling process to obtain a copper alloy material;

subjecting the copper alloy material to a cold rolling process;

subjecting the copper alloy material to a recrystallization thermal treatment process;

subjecting the copper alloy material to a cold finishing rolling process; and subjecting the copper alloy material to a recovery thermal treatment process, wherein a hot rolling initial temperature of the hot rolling process is 800° C. to 920° C., a cooling rate of the copper alloy material in a temperature range from a temperature after final rolling to 350° C. or 650° C. to 350° C. is 1° C./second or more, wherein a cold working rate in the cold rolling process is 55% or more, wherein the recrystallization thermal treatment process includes a heating step of heating the copper alloy material to a peak temperature, Tmax (° C.), a holding step of holding the copper alloy material in a temperature range of a temperature 50° C. lower than the peak temperature of the copper alloy material to the peak temperature after the heating step and a cooling step of cooling the copper alloy material after the holding step, wherein in the recrystallization thermal treatment process, when the peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), expressions of $540 \leq Tmax \leq 780$, $0.04 \leq tm \leq 2$, and $450 \leq \{Tmax - 40 \times tm^{-1/2} - 50 \times (1 - RE/100)^{1/2}\} \leq 580$ are satisfied, wherein the recovery thermal treatment process includes a heating step of heating the copper alloy material to a peak temperature, Tmax2 (° C.), a holding step of holding the copper alloy material in a temperature range of a temperature 50° C. lower than the peak temperature of the copper alloy material to the peak temperature after the heating step and a cooling step of cooling the copper alloy material after the holding step, wherein in the recovery thermal treatment process, when the peak temperature of the copper alloy material is denoted by Tmax2 (° C.), a holding time in a temperature range of a temperature 50° C. lower than the peak temperature of the copper alloy material to the peak temperature is denoted by tm2 (min), and the cold working rate in the cold rolling step is denoted by RE2(%), expressions of $160 \leq Tmax2 \leq 650$, $0.029 \leq tm2 \leq 200$, and $100 \leq \{Tmax2 - 40 \times tm2^{-1/2} - 50 \times (1 - RE2/100)^{1/2}\} \leq 360$ are satisfied, wherein an average crystal grain diameter of the copper alloy material before the cold finishing rolling process is 1.2 μm to 5.0 μm, round or oval precipitates are present in the copper alloy material before the cold finishing rolling process, an average grain diameter of the precipitates is 4.0 nm to 25.0 nm or a proportion of precipitates having a grain diameter of 4.0 nm to 25.0 nm in the precipitates is 70% or more, wherein the copper alloy sheet contains 5.0 mass % to 12.0 mass % of Zn, 1.1 mass % to 2.5 mass % of Sn, 0.01 mass % to 0.09 mass % of P and 0.6 mass % to 1.5 mass % of Ni with a remainder of Cu and inevitable impurities, and wherein a content of Zn [Zn] mass %, a content of Sn [Sn] mass %, a content of P [P] mass % and a content of Ni [Ni] mass % have a relationship of $20 \leq [Zn] + 7 \times [Sn] + 15 \times [P] + 4.5 \times [Ni] \leq 32$.

3. A method for manufacturing a copper alloy sheet, sequentially comprising:

subjecting an ingot to a hot rolling process to obtain a copper alloy material;

subjecting the copper alloy material to a cold rolling process;

subjecting the copper alloy material to a recrystallization thermal treatment process; and subjecting the copper alloy material to a cold finishing rolling process, wherein a hot rolling initial temperature of the hot rolling process is 800° C. to 920° C., a cooling rate of the copper alloy material in a temperature range from a temperature after final rolling to 350° C. or 650° C. to 350° C. is 1° C./second or more, wherein a cold working rate in the cold rolling process is 55% or more, wherein the recrystallization thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, wherein in the recrystallization thermal treatment process, when a peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), $540 \leq Tmax \leq 780$, $0.04 \leq tm \leq 2$, and $450 \leq \{Tmax - 40 \times tm^{-1/2} - 50 \times (1 - RE/100)^{1/2}\} \leq 580$, wherein an average crystal grain diameter of the copper alloy material before the cold finishing rolling process is 1.2 μm to 5.0 μm, round or oval precipitates are present in the copper alloy material before the cold finishing rolling process, an average grain diameter of the precipitates is 4.0 nm to 25.0 nm or a proportion of precipitates having a grain diameter of 4.0 nm to 25.0 nm in the precipitates is 70% or more, wherein the copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co and 0.6 mass % to 1.5 mass % of Ni with a remainder of Cu and inevitable impurities, and wherein a content of Zn [Zn] mass %, a content of Sn [Sn] mass %, a content of P [P] mass %, a content of Co [Co] mass % and a content of Ni [Ni] mass % have a relationship of $20 \leq [Zn] + 7 \times [Sn] + 15 \times [P] + 12 \times [Co] + 4.5 \times [Ni] \leq 32$.

4. A method for manufacturing a copper alloy sheet, sequentially comprising:

subjecting an ingot to a hot rolling process to obtain a copper alloy material;

subjecting the copper alloy material to a cold rolling process;

subjecting the copper alloy material to a recrystallization thermal treatment process;

subjecting the copper alloy material to a cold finishing rolling process; and subjecting the copper alloy material to a recovery thermal treatment process, wherein a hot rolling initial temperature of the hot rolling process is 800° C. to 920° C., a cooling rate of the copper alloy material in a temperature range from a temperature after final rolling to 350° C. or 650° C. to 350° C. is 1° C./second or more, wherein a cold working rate in the cold rolling process is 55% or more, wherein the recrystallization thermal treatment process includes a heating step of heating the copper alloy material to a peak temperature, Tmax (° C.), a holding step of holding the copper alloy material in a temperature range of a temperature 50° C. lower than the peak temperature of the copper alloy material to the peak temperature after the heating step and a cooling step of cooling the copper alloy material after the holding step, wherein in the recrystallization thermal treatment process, when the peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), expressions of $540 \leq Tmax \leq 780$, $0.04 \leq tm \leq 2$, and $450 \leq \{Tmax - 40 \times tm^{-1/2} - 50 \times (1 - RE/100)^{1/2}\} \leq 580$ are satisfied, wherein the recovery thermal treatment process includes a heating step of heating the copper alloy material to a peak temperature, Tmax2 (° C.), a holding step of holding the copper alloy material in a temperature range of a temperature 50° C. lower than the peak temperature of the copper alloy material to the peak temperature after the heating step and a cooling step of cooling the copper alloy material after the holding step, wherein in the recovery thermal treatment process, when the peak temperature of the copper alloy material is denoted by Tmax2 (° C.), a holding time in a temperature range of a temperature 50° C. lower than the peak temperature of the copper alloy material to the peak temperature is denoted by tm2 (min), and the cold working rate in the cold rolling step is denoted by RE2(%), expressions of $160 \leq Tmax2 \leq 650$, $0.02 \leq tm2 \leq 200$, and $100 \leq \{Tmax2 - 40 \times tm2^{-1/2} - 50 \times (1 - RE2/100)^{1/2}\} \leq 360$ are satisfied, wherein an average crystal grain diameter of the copper alloy material before the cold finishing rolling process is 1.2 μm to 5.0 μm, round or oval precipitates are present in the copper alloy material before the cold finishing rolling process, an average grain diameter of the precipitates is 4.0 nm to 25.0 nm or a proportion of precipitates having a grain diameter of 4.0 nm to 25.0 nm in the precipitates is 70% or more, wherein the copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co and 0.6 mass % to 1.5 mass % of Ni with a remainder of Cu and inevitable impurities, and wherein a content of Zn [Zn] mass %, a content of Sn [Sn] mass %, a content of P [P] mass %, a content of Co [Co] mass % and a content of Ni [Ni] mass % have a relationship of $20 \leq [Zn] + 7 \times [Sn] + 15 \times [P] + 12 \times [Co] + 4.5 \times [Ni] \leq 32$.

5. A method for manufacturing a copper alloy sheet, sequentially comprising:

subjecting an ingot to a hot rolling process to obtain a copper alloy material;

subjecting the copper alloy material to a cold rolling process;

subjecting the copper alloy material to a recrystallization thermal treatment process; and subjecting the copper alloy material to a cold finishing rolling process, wherein a hot rolling initial temperature of the hot rolling process is 800° C. to 920° C., a cooling rate of the copper alloy material in a temperature range from a temperature after final rolling to 350° C. or 650° C. to 350° C. is 1° C./second or more, wherein a cold working rate in the cold rolling process is 55% or more, wherein the recrystallization thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, wherein in the recrystallization thermal treatment process, when a peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), $540 \leq Tmax \leq 780$, $0.04 \leq tm \leq 2$, and $450 \leq \{Tmax - 40 \times tm^{-1/2} - 50 \times (1 - RE/100)^{1/2}\} \leq 580$, wherein an average crystal grain diameter of the copper alloy material before the cold finishing rolling process is 1.2 μm to 5.0 μm, round or oval precipitates are present in the copper alloy material before the cold finishing rolling process, an average grain diameter of the precipitates is 4.0 nm to 25.0 nm or a proportion of precipitates having a grain diameter of 4.0 nm to 25.0 nm in the precipitates is 70% or more, wherein the copper alloy sheet contains 5.0 mass % to 12.0 mass % of Zn, 1.1 mass % to 2.5 mass % of Sn, 0.01 mass % to 0.09 mass % of P, 0.6 mass % to 1.5 mass % of Ni and 0.004 mass % to 0.04 mass % of Fe with a remainder of Cu and inevitable impurities, and wherein a content of Zn [Zn] mass %, a content of Sn [Sn] mass %, a content of P [P] mass % and a content of Ni [Ni] mass % have a relationship of $20 \leq [Zn] + 7 \times [Sn] + 15 \times [P] + 4.5 \times [Ni] \leq 32$.

6. A method for manufacturing a copper alloy sheet, sequentially comprising:

subjecting an ingot to a hot rolling process to obtain a copper alloy material;

subjecting the copper alloy material to a cold rolling process;

subjecting the copper alloy material to a recrystallization thermal treatment process;

subjecting the copper alloy material to a cold finishing rolling process; and subjecting the copper alloy material to a recovery thermal treatment process, wherein a hot rolling initial temperature of the hot rolling process is 800° C. to 920° C., a cooling rate of the copper alloy material in a temperature range from a temperature after final rolling to 350° C. or 650° C. to 350° C. is 1° C./second or more, wherein a cold working rate in the cold rolling process is 55% or more, wherein the recrystallization thermal treatment process includes a heating step of heating the copper alloy material to a peak temperature, Tmax (° C.), a holding step of holding the copper alloy material in a temperature range of a temperature 50° C. lower than the peak temperature of the copper alloy material to the peak temperature after the heating step and a cooling step of cooling the copper alloy material after the holding step, wherein in the recrystallization thermal treatment process, when the peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), expressions of $540 \leq Tmax \leq 780$, $0.04 \leq tm \leq 2$, and $450 \leq \{Tmax - 40 \times tm^{-1/2} - 50 \times (1 - RE/100)^{1/2}\} \leq 580$ are satisfied, wherein the recovery thermal treatment process includes a heating step of heating the copper alloy material to a peak temperature, Tmax2 (° C.), a holding step of holding the copper alloy material in a temperature range of a temperature 50° C. lower than the peak temperature of the copper alloy material to the peak temperature after the heating step and a cooling step of cooling the copper alloy material after the holding step, wherein in the recovery thermal treatment process, when the peak temperature of the copper alloy material is denoted by Tmax2 (° C.), a holding time in a temperature range of a temperature 50° C. lower than the peak temperature of the copper alloy material to the peak temperature is denoted by tm2 (min), and the cold working rate in the cold rolling step is denoted by RE2(%), expressions of $160 \leq Tmax2 \leq 650$, $0.02 \leq tm2 \leq 200$, and $100 \leq \{Tmax2 - 40 \times tm2^{-1/2} - 50 \times (1 - RE2/100)^{1/2}\} \leq 360$ are satisfied, wherein an average crystal grain diameter of the copper alloy material before the cold finishing rolling process is 1.2 μm to 5.0 μm, round or oval precipitates are present in the copper alloy material before the cold finishing rolling process, an average grain diameter of the precipitates is 4.0 nm to 25.0 nm or a proportion of precipitates having a grain diameter of 4.0 nm to 25.0 nm in the precipitates is 70% or more, wherein the copper alloy sheet contains 5.0 mass % to 12.0 mass % of Zn, 1.1 mass % to 2.5 mass % of Sn, 0.01 mass % to 0.09 mass % of P, 0.6 mass % to 1.5 mass % of Ni and 0.004 mass % to 0.04 mass % of Fe with a remainder of Cu and inevitable impurities, and wherein a content of Zn [Zn] mass %, a content of Sn [Sn] mass %, a content of P [P] mass % and a content of Ni [Ni] mass % have a relationship of $20 \leq [Zn] + 7 \times [Sn] + 15 \times [P] + 4.5 \times [Ni] \leq 32$.

7. A method for manufacturing a copper alloy sheet, sequentially comprising:

subjecting an ingot to a hot rolling process to obtain a copper alloy material;

subjecting the copper alloy material to a cold rolling process;

subjecting the copper alloy material to a recrystallization thermal treatment process; and subjecting the copper alloy material to a cold finishing rolling process, wherein a hot rolling initial temperature of the hot rolling process is 800° C. to 920° C., a cooling rate of the copper alloy material in a temperature range from a temperature after final rolling to 350° C. or 650° C. to 350° C. is 1° C./second or more, wherein a cold working rate in the cold rolling process is 55% or more, wherein the recrystallization thermal treatment process includes a heating step of heating the copper alloy material to a predetermined temperature, a holding step of holding the copper alloy material at a predetermined temperature for a predetermined time after the heating step and a cooling step of cooling the copper alloy material to a predetermined temperature after the holding step, wherein in the recrystallization thermal treatment process, when a peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), $540 \leq Tmax \leq 780$, $0.04 \leq tm \leq 2$, and $450 \leq \{Tmax - 40 \times tm^{-1/2} - 50 \times (1 - RE/100)^{1/2}\} \leq 580$, wherein an average crystal grain diameter of the copper alloy material before the cold finishing rolling process is 1.2 μm to 5.0 μm, round or oval precipitates are present in the copper alloy material before the cold finishing rolling process, an average grain diameter of the precipitates is 4.0 nm to 25.0 nm or a proportion of precipitates having a grain diameter of 4.0 nm to 25.0 nm in the precipitates is 70% or more, wherein the copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co, 0.6 mass % to 1.5 mass % of Ni and 0.004 mass % to 0.04 mass % of Fe with a remainder of Cu and inevitable impurities, and wherein a content of Zn [Zn] mass %, a content of Sn [Sn] mass %, a content of P [P] mass %, a content of Co [Co] mass % and a content of Ni [Ni] mass % have a relationship of $20 \leq [Zn] + 7 \times [Sn] + 15 \times [P] + 12 \times [Co] + 4.5 \times [Ni] \leq 32$, and the content of Co [Co] mass % and a content of Fe [Fe] mass % have a relationship of $[Co] + 2 \times [Fe] \leq 0.08$.

8. A method for manufacturing a copper alloy sheet, sequentially comprising:

subjecting an ingot to a hot rolling process to obtain a copper alloy material;

subjecting the copper alloy material to a cold rolling process;

subjecting the copper alloy material to a recrystallization thermal treatment process;

subjecting the copper alloy material to a cold finishing rolling process; and subjecting the copper alloy material to a recovery thermal treatment process, wherein a hot rolling initial temperature of the hot rolling process is 800° C. to 920° C., a cooling rate of the copper alloy material in a temperature range from a temperature after final rolling to 350° C. or 650° C. to 350° C. is 1° C./second or more, wherein a cold working rate in the cold rolling process is 55% or more, wherein the recrystallization thermal treatment process includes a heating step of heating the copper alloy material to a peak temperature, Tmax (° C.), a holding step of holding the copper alloy material in a temperature range of a temperature 50° C. lower than the peak temperature of the copper alloy material to the peak temperature after the heating step and a cooling step of cooling the copper alloy material after the holding step, wherein in the recrystallization thermal treatment process, when the peak temperature of the copper alloy material is denoted by Tmax (° C.), a holding time in a temperature range of a temperature 50° C. lower than the peak temperature of the copper alloy material to the peak temperature is denoted by tm (min), and the cold working rate in the cold rolling step is denoted by RE (%), expressions of $540 \leq Tmax \leq 780$, $0.04 \leq tm \leq 2$, and $450 \leq \{Tmax - 40 \times tm^{-1/2} - 50 \times (1 - RE/100)^{1/2}\} \leq 580$ are satisfied, wherein the recovery thermal treatment process includes a heating step of heating the copper alloy material to a peak temperature, Tmax2 (° C.), a holding step of holding the copper alloy material in a temperature range of a temperature 50° C. lower than the peak temperature of the copper alloy material to the peak temperature after the heating step and a cooling step of cooling the copper alloy material after the holding step, wherein in the recovery thermal treatment process, when the peak temperature of the copper alloy material is denoted by Tmax2 (° C.), a holding time in a temperature range of a temperature 50° C. lower than the peak temperature of the copper alloy material to the peak temperature is denoted by tm2 (min), and the cold working rate in the cold rolling step is denoted by RE2(%), expressions of $160 \leq Tmax2 \leq 650$, $0.02 \leq tm2 \leq 200$, and $100 \leq \{Tmax2 - 40 \times tm2^{-1/2} - 50 \times (1 - RE2/100)^{1/2}\} \leq 360$ are satisfied, wherein an average crystal grain diameter of the copper alloy material before the cold finishing rolling process is 1.2 μm to 5.0 μm, round or oval precipitates are present in the copper alloy material before the cold finishing rolling process, an average grain diameter of the precipitates is 4.0 nm to 25.0 nm or a proportion of precipitates having a grain diameter of 4.0 nm to 25.0 nm in the precipitates is 70% or more, wherein the copper alloy sheet contains 5.0 mass % to 12.0 mass % of Zn, 1.1 mass % to 2.5 mass % of Sn, 0.01 mass % to 0.09 mass % of P, 0.005 mass % to 0.09 mass % of Co, 0.6 mass % to 1.5 mass % of Ni and 0.004 mass % to 0.04 mass % of Fe with a remainder of Cu and inevitable impurities, and wherein a content of Zn [Zn] mass %, a content of Sn [Sn] mass %, a content of P [P] mass %, a content of Co [Co] mass % and a content of Ni [Ni] mass % have a relationship of $20 \leq [Zn] + 7 \times [Sn] + 15 \times [P] + 12 \times [Co] + 4.5 \times [Ni] \leq 32$, and the content of Co [Co] mass % and a content of Fe [Fe] mass % have a relationship of $[Co] + 2 \times [Fe] \leq 0.08$.

* * * * *